US010659873B2

(12) United States Patent
Elko et al.

(10) Patent No.: US 10,659,873 B2
(45) Date of Patent: May 19, 2020

(54) SPATIAL ENCODING DIRECTIONAL MICROPHONE ARRAY

(71) Applicant: MH Acoustics, LLC, Summit, NJ (US)

(72) Inventors: Gary W. Elko, Summit, NJ (US); Tomas F. Gaensler, Warren, NJ (US); Jens M. Meyer, Fairfax, VT (US); Eric J. Diethorn, Long Valley, NJ (US)

(73) Assignee: MH Acoustics, LLC, Summit, NJ (US)

( * ) Notice: Subject to any disclaimer, the term of this patent is extended or adjusted under 35 U.S.C. 154(b) by 0 days.

(21) Appl. No.: 16/524,633

(22) Filed: Jul. 29, 2019

(65) Prior Publication Data

US 2019/0349675 A1 Nov. 14, 2019

Related U.S. Application Data

(63) Continuation of application No. 16/383,928, filed on Apr. 15, 2019, which is a continuation-in-part of (Continued)

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01)

(58) Field of Classification Search
USPC ..... 381/91, 92, 94.1, 94.2, 94.3, 94.7, 111, 381/122, 355, 375
See application file for complete search history.

(56) References Cited

U.S. PATENT DOCUMENTS 4,042,779 A 8/1977 Craven et al.
5,473,701 A 12/1995 Cezanne et al.
(Continued)

FOREIGN PATENT DOCUMENTS

GB 2375276 A 11/2002
GB 2495131 A 4/2013
WO WO2014062152 A1 4/2014

OTHER PUBLICATIONS

International Search Report and Written Opinion; dated Oct. 4, 2017 for PCT Application No. PCT/US2017/036988.
(Continued)

*Primary Examiner* — Yosef K Laekemariam
(74) *Attorney, Agent, or Firm* — Mendelsohn Dunleavy, P.C.; Steve Mendelsohn

(57) ABSTRACT

In one embodiment, an article of manufacture has microphones mounted at different locations on a non-spheroidal device body and a signal-processing system that processes the microphone signals to generate a B Format audio output having a zeroth-order beampattern signal and three first-order beampattern signals in three orthogonal directions. The signal-processing system generates at least one of the first-order beampattern signals based on effects of the device body on an incoming acoustic signal. The microphone signals used to generate each first-order beampattern signal have an inter-microphone effective distance that is less than a wavelength at a specified high-frequency value (e.g., <4 cm for 8 kHz). In preferred embodiments, the inter-microphone effective distance is less than one-half of that wavelength (e.g., <2 cm for 8 kHz). In addition, the inter-phase-center effective distances for the different first-order beampattern signals are also less than that wavelength, and preferably less than one-half of that wavelength.

20 Claims, 7 Drawing Sheets

Related U.S. Application Data application No. 15/571,525, filed as application No. PCT/US2017/036988 on Jun. 12, 2017, now Pat. No. 10,356,514.

(60) Provisional application No. 62/350,240, filed on Jun. 15, 2016.

(56) References Cited

U.S. PATENT DOCUMENTS

| | | | | |
|---|---|---|---|---|
| 6,041,127 | A | 3/2000 | Elko | |
| 6,256,146 | B1 * | 7/2001 | Merrill | G02B 5/3008 252/585 |
| 7,587,054 | B2 | 9/2009 | Elko et al. | |
| 8,204,252 | B1 * | 6/2012 | Avendano | H04R 3/005 381/92 |
| 8,433,075 | B2 | 4/2013 | Elko et al. | |
| 8,942,387 | B2 | 1/2015 | Elko et al. | |
| 9,202,475 | B2 | 12/2015 | Elko et al. | |
| 9,729,994 | B1 | 8/2017 | Eddins et al. | |
| 9,980,075 | B1 | 5/2018 | Benattar | |
| 10,206,040 | B2 | 2/2019 | Kolb et al. | |
| 2011/0235822 | A1 | 9/2011 | Jeong et al. | |
| 2012/0128160 | A1 * | 5/2012 | Kim | G11B 20/00 381/17 |
| 2014/0105416 | A1 | 4/2014 | Huttunen et al. | |
| 2015/0055796 | A1 | 2/2015 | Nugent et al. | |
| 2016/0066117 | A1 | 3/2016 | Chen et al. | |
| 2016/0071526 | A1 | 3/2016 | Wingate et al. | |
| 2016/0165341 | A1 * | 6/2016 | Benattar | H04R 1/406 381/92 |

OTHER PUBLICATIONS

Gibson, J. J. et al. "Compatible FM Broadcasting of Panoramic Sound," IEEE Transactions on Broadcast and Television Receivers 4 (1973): pp. 286-293.

Fellgett, P. "Ambisonics. Part one: General system description," Studio Sound, Aug. 1975, pp. 20-22, vol. 17, IPC Media Ltd., UK.

Gerzon, M. "Ambisonics. Part two: Studio Techniques," Studio Sound, Aug. 1975, pp. 24-26, vol. 17, IPC Media Ltd., UK.

Elko, G. W. "A Steerable and Variable First-Order Differential Microphone Array," IEEE International Conference on In Acoustics, Speech, and Signal Processing,1997, vol. 1, pp. 223-226.

Williams, E. G. "Fourier Acoustics: Sound Radiation and Newfield Acoustical Holography," 1999, Academic Press, UK.

McGowan, I. "Microphone Arrays: A Tutorial," Queensland University, Apr. 2001, pp. 1-36, Australia.

Grant, M. et al. "The CVX Users' Guide. Release 2.1," CVX Research, Inc., Mar. 30, 2017.

Rafaely, B. "Fundamentals of Spherical Array Processing," Springer Topics in Signal Processing, 2015, vol. 8., Springer, Germany.

Written Opinion; dated May 7, 2018 for PCT Application No. PCT/US2017/036988.

Menzer, F. et al. "Obtaining Binaural Room Impulse Responses From B-Format Impulse Responses Using Frequency-Dependent Coherence Matching," IEEE Transactions on Audio, Speech, and Language Processing, Feb. 2011, pp. 396-405, vol. 19, No. 2, IEEE.

* cited by examiner

600

700
FRONT
710

700
BACK
711

750
FRONT
760

750
BACK
761
x
y
z
701
702
703
704
705
706
707
708
712
713
714
715
751
752
753
754
755
762
763
764
765

SPATIAL ENCODING DIRECTIONAL MICROPHONE ARRAY

CROSS-REFERENCE TO RELATED APPLICATIONS

This is a continuation of U.S. patent application Ser. No. 16/383,928, filed on Apr. 15, 2019, which was a continuation-in-part of U.S. patent application Ser. No. 15/571,525, filed on Nov. 3, 2017, which application claims the benefit of the filing date of U.S. provisional application No. 62/350,240, filed on Jun. 15, 2016, the teachings of all of which are incorporated herein by reference in their entirety.

BACKGROUND

Field of the Invention

The present invention relates to acoustics, and, in particular but not exclusively, to techniques for the capture of the spatial sound field on mobile devices, such as laptop computers, cell phones, and cameras.

Description of the Related Art

This section introduces aspects that may help facilitate a better understanding of the invention. Accordingly, the statements of this section are to be read in this light and are not to be understood as admissions about what is prior art or what is not prior art.

Due to the low cost of high-performance matched microphones and the commensurate increase in digital signal processing capabilities in mobile communication devices, realistic high-quality spatial audio pick-up from mobile devices is now becoming possible. Recording of spatial audio signals has been known since the invention of stereo recording at Bell Labs in the early 1930's. Gibson, Christensen, and Limberg in 1972, gave a fundamental description of three-dimensional audio spatial playback. See J. J. Gibson, R. M. Christensen, and A. L. R. Limberg, "Compatible FM Broadcasting of Panoramic Sound," J. Audio Eng. Soc., vol. 20, pp. 816-822, December 1972, the teachings of which are incorporated herein by reference in their entirety. It is interesting that these authors discussed higher-order playback systems.

A first-order three-dimensional spatial recording was later proposed by Fellgett and Gerzon in 1975 who described a first-order "B-format ambisonic" SoundField® microphone array constructed of four cardioid capsules mounted in a tetrahedral arrangement. See Peter Fellgett, "Ambisonics, Part One: General System Description," Studio Sound, vol. 17, no. 8, pp. 20-22, 40, August 1975; Michael Gerzon, "Ambisonics, Part Two: Studio Techniques," Studio Sound, vol. 17, no. 8, pp. 24, 26, 28-30, August 1975; and U.S. Pat. No. 4,042,779, the teachings of all three of which are incorporated by reference in their entirety.

Later, Elko proposed a spherical microphone array with six pressure microphones mounted on a rigid sphere that utilized first-order spherical harmonics. See G. W. Elko, "A steerable and variable first-order differential microphone array," IEEE ICASSP proceedings, April 1997, and U.S. Pat. No. 6,041,127, the teachings of both of which are incorporated herein by reference in their entirety.

More-accurate spatial recording using higher-order spherical harmonics or, equivalently, Higher-Order Ambisonics (HOA) was thought to be difficult to construct due to the required measurement of higher-order spatial derivative signals of the acoustic pressure field. The measurement of higher-order spatial derivatives is problematic due to the loss of SNR due to the natural high-pass nature of the acoustic pressure derivative signals and the commensurate need in post-processing to equalize these high-pass signals with a corresponding low-pass filter. Since the uncorrelated microphone self-noise and electrical noises of preamplifiers are invariant under differential processing, the low-pass equalization filter can amplify these noise components greatly, especially at lower frequencies and higher differential orders. One practical solution to extracting the higher-order differential modes by employing many pressure microphones mounted on a rigid spherical baffle and associated signal processing to extract the higher-order spatial spherical harmonics was proposed and patented by Meyer and Elko. See U.S. Pat. No. 7,587,054 (the "'054 patent") and U.S. Pat. No. 8,433,075 (the "'075 patent"), the teachings of both of which are incorporated herein by reference in their entirety.

A mathematical series representation of a three-dimensional (3D) scalar pressure field is based on signals that are proportional to the zero-order and the higher-order pressure gradients of the field up to the desired highest order of the field series expansion. The basic zero-order omnidirectional term is the scalar acoustic pressure that can be measured by one or more of the pressure microphone elements. For all three first-order components, the acoustic pressure field is sufficiently sampled so that the three Cartesian orthogonal differentials can be resolved along with the acoustic pressure. Three first-order spatial derivatives in mutually orthogonal directions can be used to estimate the first-order gradient of the scalar pressure field. The smallest number of pressure microphones that span 3D space for up to first-order operation is therefore four microphones, preferably in a tetrahedral arrangement.

SUMMARY

Certain embodiments of the present invention relate to a technique that processes audio signals from multiple microphones to generate a basis set of signals that are used for further post-processing for the manipulation or playback of spatial audio signals. Playback can be either over one or more loudspeakers or binaurally rendered over headphones.

BRIEF DESCRIPTION OF THE DRAWINGS

Embodiments of the invention will become more fully apparent from the following detailed description, the appended claims, and the accompanying drawings in which like reference numerals identify similar or identical elements.

FIG. 2A shows a directivity plot for a first-order array, where $\alpha=0.55$, while

DETAILED DESCRIPTION

Figure 1:
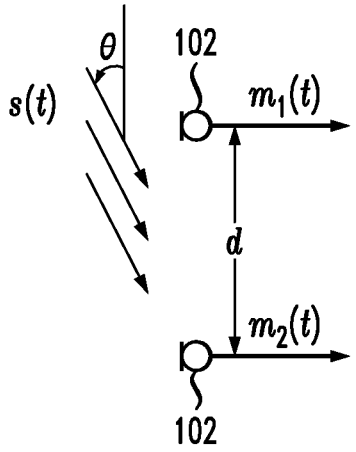
FIG. 1 illustrates a first-order differential microphone.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

As used in this specification, the term "acoustic signals" refers to sounds, while the term "audio signals" refers to the analog or digital electronic signals that represent sounds, such as the electronic signals generated by microphones based on incoming acoustic signals and/or the electronic signals used by loudspeakers to render outgoing acoustic signals.

As used in this specification, the term "loudspeaker" refers to any suitable transducer for converting electronic audio signals into acoustic signals (including headphones), while the term "microphone" refers to any suitable transducer for converting acoustic signals into electronic audio signals. The electronic audio signal generated by a microphone is also referred to herein as a "microphone signal."

Spatial Sound Fields

An acoustic scalar pressure sound field can be expressed as the superposition of acoustic waves that obey the acoustic wave equation, which can be written for spherical coordinates according to Equation (1) as follows:

$$\frac{1}{r^2}\frac{\partial}{\partial_r}\left(r^2\frac{\partial p}{\partial r}\right)+\frac{1}{r^2\sin\theta}\frac{\partial}{\partial\theta}\left(\sin\theta\frac{\partial p}{\partial\theta}\right)+\frac{1}{r^2\sin\theta}\frac{\partial^2 p}{\partial\phi^2}-\frac{1}{c^2}\frac{\partial^2 p}{\partial t^2}=0, \tag{1}$$

where c is the speed of sound, and the pressure field p is a function of radial distance r, polar angle θ, azimuthal angle ϕ, and time t. For 3D sound fields, it is convenient (but not necessary) to express the wave equation in spherical coordinates.

The general solution for the scalar acoustic pressure field can be written as a separation of variables according to Equation (2) as follows:

$$p(r,\theta,\phi,t)=R(r)\Theta(\theta)\Phi(\phi)T(t), \tag{2}$$

The general solution contains the radial spherical Hankel function R(r), the angular functions Θ(θ) and Φ(ϕ), as well as the time function T (t). If it is assumed that the time signal is periodic, then the time dependence can be dropped from Equation (2) without losing generality where the periodicity is now represented as a spatial frequency (or wavenumber) $k=\omega/c=2\pi/\lambda$ where ω is the angular frequency and λ is the acoustic wavelength. The angular functions include the associated Legendre function Θ(θ) in terms of the standard spherical polar angle θ (that is, the angle from the z-axis) and the complex exponential function Φ(ϕ) in terms of the standard spherical azimuthal angle ϕ (that is, the longitudinal angle in the x-y plane from the x-axis, where the counterclockwise direction is the positive direction).

The angular component (Θ(θ)Φ(ϕ)) of the solution is often condensed and written in terms of the complex spherical harmonics $Y_n^m(\theta, \phi)$ that are defined according to Equation (3) as follows:

$$Y_n^m(\theta,\phi)=\sqrt{\frac{2n+1(n-m)!}{4\pi(n+m)!}}\,P_n^m(\cos\theta)e^{-im\phi}, \tag{3}$$

where the index n is the order and the index m is the degree of the function (flipped from conventional terminology), the term under the square-root is a normalization factor to maintain orthonormality of the spherical harmonic functions (i.e., the inner product is unity for two functions with the same order and degree and zero for any other inner product of two functions where the order and/or the degree are not the same), $P_n^m(\cos\theta)$ is the Legendre polynomial of order n and degree m, and i is the square root of −1.

The radial term (R(r)) of the solution can be written according to Equation (4) as follows:

$$R(r)=A\,h^{(1)}(kr)+B\,h^{(2)}(kr), \tag{4}$$

where A and B are general weighting coefficients and $h^{(1)}(kr)$ and $h^{(2)}(kr)$ are the spherical Hankel functions of the first and second kind. The first term on the right-hand side (RHS) of Equation (4) indicates an outgoing wave, while the second RHS term contains the form for incoming waves. The use of either Hankel function depends on the type of acoustic field problem that is being solved: either the first kind for the exterior field problem or the second kind for the solution to an interior field problem. An exterior problem determines an equation for the sound propagating from a region containing a sound source. An interior problem determines an equation for sound entering a region from one or more sound sources located outside the region of interest, like sound impinging on a microphone array from the farfield.

By completeness of the spherical harmonic functions, any traveling wave solution p(r,θ,Ø,ω) that is continuous and mean-square integrable can be expanded as an infinite series according to Equation (5) as follows:

$$p(r,\theta,\phi,\omega)=\Sigma_{n=0}^{\infty}\Sigma_{m=-n}^{n}[A_{mn}h_n^{(1)}(kr)+B_{mn}h_n^{(2)}(kr)]\,Y_n^m(\theta,\phi). \tag{5}$$

For an interior problem with all sources outside the region of interest, the solution of Equation (5) can be reduced to a solution containing only the incoming wave component according to Equation (6) as follows:

$$p(r,\theta,\phi,\omega)=\Sigma_{n=0}^{\infty}\Sigma_{m=-n}^{n}B_{mn}j_n(kr)Y_n^m(\theta,\phi). \tag{6}$$

where the incoming wave represented by $h^{(2)}$ (kr) has to be finite at the origin and therefore the solution reduces to the spherical Bessel function $j_n$. At radius $r_0$, which defines the outer boundary of the surface of the interior region, the values of the weighting coefficients $B_{mn}$ are computed according to Equation (7) as follows:

$$B_{mn} = \frac{1}{h^{(2)}(kr_0)}\int_0^{2\pi}\int_0^{\pi} p(r_0, \theta, \phi)Y_n^m(\theta, \phi)^*\sin(\theta)d\theta d\phi, \tag{7}$$

where the * indicates the complex conjugate. The terms $B_{mn}$ are the complex spherical harmonic Fourier coefficients, sometimes referred to as the multipole coefficients since they are related to the strength of the various "poles" that are represented by terms of a multipole expansion (monopole, dipole, quadrupole, etc.). Thus, the complete interior solution for any point (r,θ,ϕ) within the measurement radius ($r \le r_0$) can be written according to Equation (8) as follows:

$$p(r, \theta, \phi, \omega) = \sum_{n=0}^{\infty}\frac{h^{(2)}(kr)}{h^{(2)}(kr_0)} \sum_{m=-n}^{n} Y_n^m(\theta, \phi)\int_0^{2\pi}\int_0^{\pi} p(r_0, \theta', \phi')Y_n^m(\theta', \phi')^*\sin(\theta')d\theta'\delta\phi'. \tag{8}$$

From the above equations, it can be seen that a scalar acoustic sound field can be represented by an infinite number of weighted spherical harmonic functions. Equation (9) shows a collection of the complex spherical harmonics up through first order as follows:

$$Y_0^0(\theta, \phi) = \frac{1}{2}\sqrt{\frac{1}{\pi}} \tag{9}$$

$$Y_1^{-1}(\theta, \phi) = \frac{1}{2}\sqrt{\frac{3}{2\pi}}\sin\theta e^{-i\phi}$$

$$Y_1^0(\theta, \phi) = \frac{1}{2}\sqrt{\frac{3}{\pi}}\cos\theta.$$

$$Y_1^1(\theta, \phi) = -\frac{1}{2}\sqrt{\frac{3}{2\pi}}\sin\theta e^{i\phi}$$

The zeroth order of the field represents the "omnidirectional" component in that this spherical harmonic does not have any dependency on θ or ϕ. The first-order terms contain three components that are equivalent to three orthogonal dipoles, one along each Cartesian axis. The weighting of each spherical harmonic in the representation depends on the actual acoustic field. Additionally, as mentioned previously, the solution to the wave equation also contains frequency-dependent weighting terms that are the spherical Bessel functions of the first kind, which are related to the Hankel functions of the first kind.

If the sound field is sampled on a small sphere of radius $a<r_0$, then the above field equations can be used to compute any of the spherical harmonic components at radius a from only the knowledge of the acoustic pressure on the surface defined by $r=r_0$. If it is assumed that (i) the signal is from a farfield source and can be modeled as an incident plane wave with wavevector k and (ii) r is defined as the radius vector from the origin of the coordinate system, then the solution can be simplified according to Equation (10)

$$e^{ik\cdot r}=4\pi\Sigma_{n=0}^{\infty}i^n j_n(kr)\Sigma_{m=-n}^{n}Y_n^m(\theta_r,\varnothing_r)Y_n^m(\theta_k,\varnothing_k)^*. \tag{10}$$

See Earl G. Williams, Fourier Acoustics: Sound Radiation and Nearfield Acoustic Holography, Academic Press, 1999, the teachings of which are incorporated herein by reference in their entirety.

The spherical Bessel function $j_n$(kr) near the origin (where kr<<1) can be approximated by the small-argument approximation according to Equation (11) as follows:

$$j_n(kr) \approx \frac{(kr)^n}{(2n+1)!!}, \text{ for } kr<<1 \tag{11}$$

where the double factorial indicates the product of only odd integers up to and including the argument. Equation (11) shows that a spherical harmonic expansion of an incident plane wave around the origin contains frequency-dependent terms that are proportional to $\omega^n$ (recall that $k=\omega/c$) where n is the order. Only the zeroth-order term is non-zero in the limit as $r\to 0$, which is intuitive since this would represent the case of a single pressure microphone which can sample only the zeroth-order component of the incident wave. It should also be noted that the frequency-response term $(kr)^n$ in Equation (11) is identical to that of an nth-order differential microphone. Differential microphone arrays are closely related to the multipole expansion of sound fields where the source is modeled in terms of spatial derivatives along the Cartesian axes. The spherical harmonic expansion is not the same as the multipole expansion since the multipole expansion cannot be represented as a set of orthogonal polynomials beyond first order. For first-order expansions, both the multipole and the spherical harmonic expressions contain the zeroth-order pressure term and three orthogonal dipoles with the dipole terms having a first-order high-pass response for spatial sampling when kr<<1.

From the previous discussion, first-order scalar acoustic field decomposition requires only the zeroth-order monopole and three first-order orthogonal dipole components as defined in Equation (9). These four basis signals define the Ambisonics "B-Format" spatial audio recording scheme. Thus, spatial recording of a soundfield with a small device (a device that can be smaller than the acoustic wavelength) can involve the measurement of signals that are related to spatial pressure and pressure differentials of at least first order. The next section describes how to measure the first-order pressure differential. Higher-order decompositions are described in the '054 patent, the '075 patent, and Boaz Rafaely, *Fundamentals of Spherical Array Processing*, Springer 2015, the teachings of which are incorporated herein by reference in their entirety.

Differential Microphone Arrays

Differential microphones respond to spatial differentials of a scalar acoustic pressure field. The highest order of the differential components that the microphone responds to denotes the order of the microphone. Thus, a microphone that responds to both the acoustic pressure and the first-order difference of the pressure is denoted as a first-order differential microphone. One requisite for a microphone to respond to the spatial pressure differential is the implicit constraint that the microphone size is smaller than the acoustic wavelength. Differential microphone arrays can be seen as directly analogous to finite-difference estimators of continuous spatial-field derivatives along the direction of the microphone elements. Differential microphones also share strong similarities to superdirectional arrays used in electromagnetic antenna design and multipole expansions used to model acoustic radiation. The well-known problems with implementation of superdirectional arrays are the same as those encountered in the realization of differential microphone arrays. It has been found that a practical limit for differential microphones using currently available transducers is at third order. See G. W. Elko, "Superdirectional Microphone Arrays," *Acoustic Signal Processing for Telecommunication*, Kluwer Academic Publishers, Chapter 10, pp. 181-237, March, 2000, the teachings of which are incorporated herein by reference in their entirety.

First-Order Dual-Microphone Array

FIG. 1 illustrates a first-order differential microphone 100 having two closely spaced pressure (i.e., omnidirectional) microphones 102 spaced at a distance d apart, with a plane wave s(t) of amplitude $S_o$ and wavenumber k incident at an angle θ from the axis of the two microphones. Note that, in this section, θ is used to represent the polar angle of the spherical coordinate system.

The output $m_i(t)$ of each microphone spaced at distance d for a time-harmonic plane wave of amplitude $S_o$ and frequency coincident from angle θ can be written according to Equation (12) as follows:

$$m_1(t)=S_o e^{j\omega t-jkd\cos(\theta)/2}$$

$$m_2(t)=S_o e^{j\omega t+jkd\cos(\theta)/2} \tag{12}$$

where j is the square root of −1.

The output E (θ,t) of a weighted addition of the two microphones can be written according to Equation (13) as follows:

$$E(\theta,t)=w_1m_1(t)+w_2m_2(t)=S_o e^{j\omega t}[(w_1+w_2)+(w_1-w_2)jkd\cos(\theta)/2+h.o.t.]. \tag{13}$$

where $w_1$ and $w_2$ are weighting values applied to the first and second microphone signals, respectively, and "h.o.t." denotes higher-order terms.

Figure 2A:
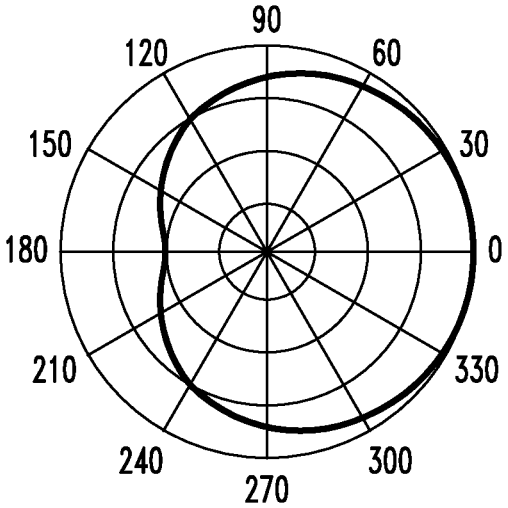

When kd<<π, the higher-order terms can be neglected. If $w_1=w_2$, then we have the pressure difference between two closely spaced microphones. This specific case results in a dipole directivity pattern cos(θ) as can easily be seen in Equation (13), which is also the pattern of the first-order spherical harmonic. Any first-order differential microphone beampattern can be written as the sum of a zero-order (omnidirectional) term and a first-order dipole term (cos(θ)). Thus, a first-order differential microphone has a normalized directional pattern E that can be written according to Equation (14) as follows:

$$E(\theta)=\alpha\pm(1-\alpha)\cos(\theta), \tag{14}$$

where typically 0≤α≤1, such that the response is normalized to have a maximum value of 1 at θ=0°, and for generality, the ± indicates that the pattern can be defined as having a maximum either at θ=0° or θ=π. One implicit property of Equation (14) is that, for 0≤α≤1, there is a maximum at θ=0° and a minimum at an angle between π/2 and π. For values of 0.5<α≤1, the response has a minimum at π, although there is no zero in the response. A microphone with this type of directivity is typically called a "sub-cardioid" microphone. FIG. 2A shows an example of the response for this case. In particular, FIG. 2A shows a directivity plot for a first-order array, where α=0.55.

When α=0.5, the parametric algebraic equation has a specific form called a cardioid. The cardioid pattern has a zero response at θ=180°. For values of 0≤α≤0.5, there is a null at angle $\theta_{null}$ as given by Equation (15) as follows:

$$\theta_{null}=\cos^{-1}\frac{\alpha}{\alpha-1}. \tag{15}$$

Figure 2B:
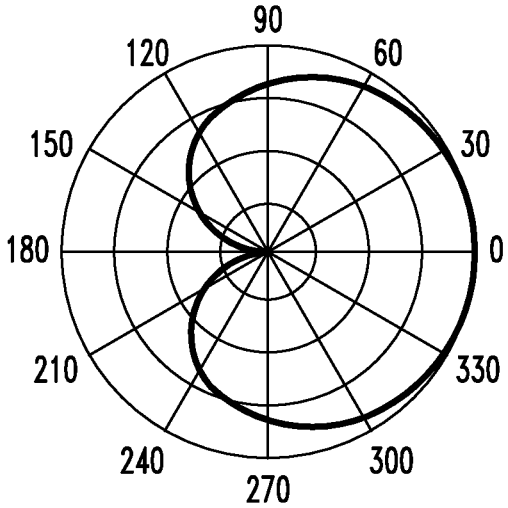
FIG. 2B shows a directional response corresponding to $\alpha=0.5$ which is the cardioid pattern.

FIG. 2B shows a directional response corresponding to α=0.5 which is the cardioid pattern. The concentric rings in the polar plots of FIGS. 2A and 2B are 10 dB apart.

A computationally simple and elegant way to form a general first-order differential microphone is to form a scalar combination of forward-facing and backward-facing cardioid signals. These signals can be obtained by using both solutions in Equation (14) and setting α=0.5. The sum of these two cardioid signals is omnidirectional (since the cos(θ) terms subtract out), and the difference is a dipole pattern (since the constant term α subtracts out).

Figure 3:
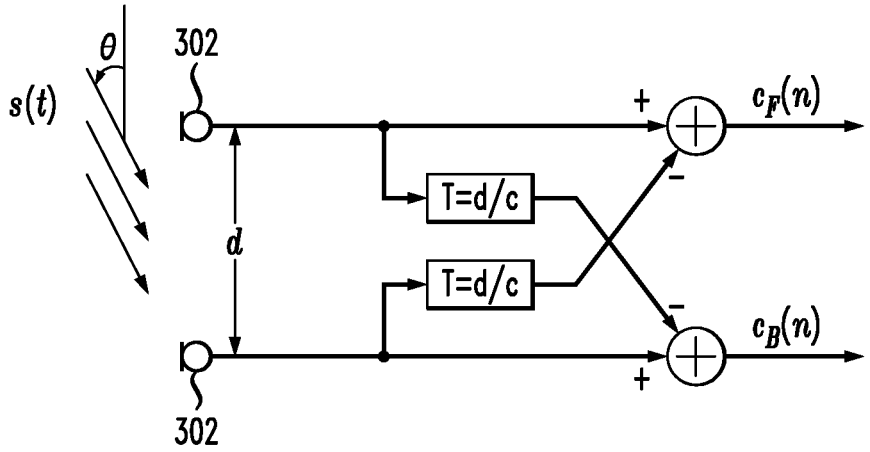
FIG. 3 shows a signal-processing system that uses an appropriate differential combination of the audio signals from two omnidirectional microphones to obtain back-to-back cardioid signals.

FIG. 3 shows a signal-processing system that uses an appropriate differential combination of the audio signals from two omnidirectional microphones 302 to obtain back-to-back cardioid signals $c_F(n)$ and $c_B(n)$. See U.S. Pat. No. 5,473,701, the teachings of which are incorporated herein by reference in their entirety. Cardioid signals can be formed from two omnidirectional microphones by including a delay (T) before the subtraction (which is equal to the propagation time (d/c) between the two microphones for sounds impinging along the microphone pair axis).

Figure 4:
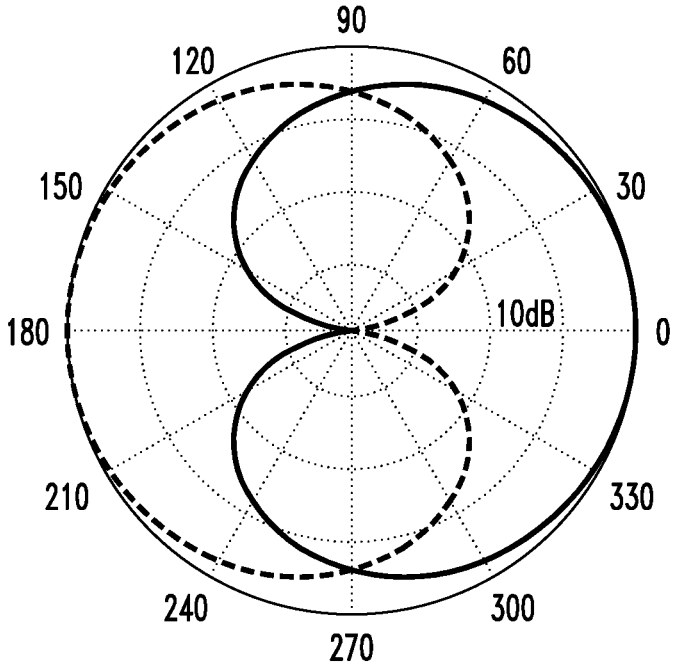
FIG. 4 shows directivity patterns for the back-to-back cardioids of FIG. 3.

FIG. 4 shows directivity patterns for the back-to-back cardioids of FIG. 3. The solid curve is the forward-facing cardioid signal $c_F(n)$, and the dashed curve is the backward-facing cardioid signal $c_B(n)$.

A practical way to realize the back-to-back cardioid arrangement shown in FIG. 3 is to carefully choose (i) the spacing between the microphones and (ii) the sampling period of the A/D converter used to digitize the analog microphone signals to be equal to some integer fraction of the corresponding delay. By choosing the sampling rate in this way, the cardioid signals can be generated by combining input signals that are offset by an integer number of samples. This approach removes the additional computational cost of interpolation filtering to obtain the delay.

By combining the microphone signals defined in Equation (12) with the delay and subtraction as shown in FIG. 3, a forward-facing cardioid signal $C_F(kd,\theta)$ can be represented according to Equation (16) as follows:

$$C_F(kd,\theta)=-2jS_o\sin(kd)[1+\cos\theta]/2). \tag{16}$$

Similarly, the backward-facing cardioid signal $C_B(kd,\theta)$ can similarly be written according to Equation (17) as follows:

$$C_B(kd,\theta)=-2jS_o\sin(kd)[1-\cos\theta]/2). \tag{17}$$

If both the forward-facing and backward-facing cardioid signals are averaged together, then the resulting output is given according to Equation (18) as follows:

$$E_{c\text{-}omni}(kd,\theta)=\tfrac{1}{2}[C_F(kd,\theta)+C_B(kd,\theta)]=-2jS_o\sin(kd/2)\cos([kd/2]\cos\theta). \tag{18}$$

For small kd, Equation (18) has a frequency response that is a first-order high-pass function, and the directional pattern is omnidirectional.

The subtraction of the forward-facing and backward-facing cardioids yields the dipole response according to Equation (19) as follows:

$$E_{c\text{-}dipole}(kd,\theta)=C_F(kd,\theta)-C_B(kd,\theta)=-2jS_o\cos(kd/2)\sin([kd/2]\cos\theta). \quad (19)$$

A dipole constructed by subtracting the two pressure microphone signals has the response given by Equation (20) as follows:

$$E_{dipole}(kd,\theta)=-2jS_o\sin([kd/2]\cos\theta). \quad (20)$$

One observation to be made from Equation (20) is that, for signals arriving along the axis of the microphone pair, the dipole's first zero occurs at twice the value of the cardioid-derived omnidirectional term (kd=2π) (i.e., for an omnidirectional signal formed by summing two back-to-back cardioids), while the dipole's first zero occurs at the value of the cardioid-derived dipole term (kd=π) (i.e., for a dipole signal formed by differencing two back-to-back cardioids).

Figure 5:
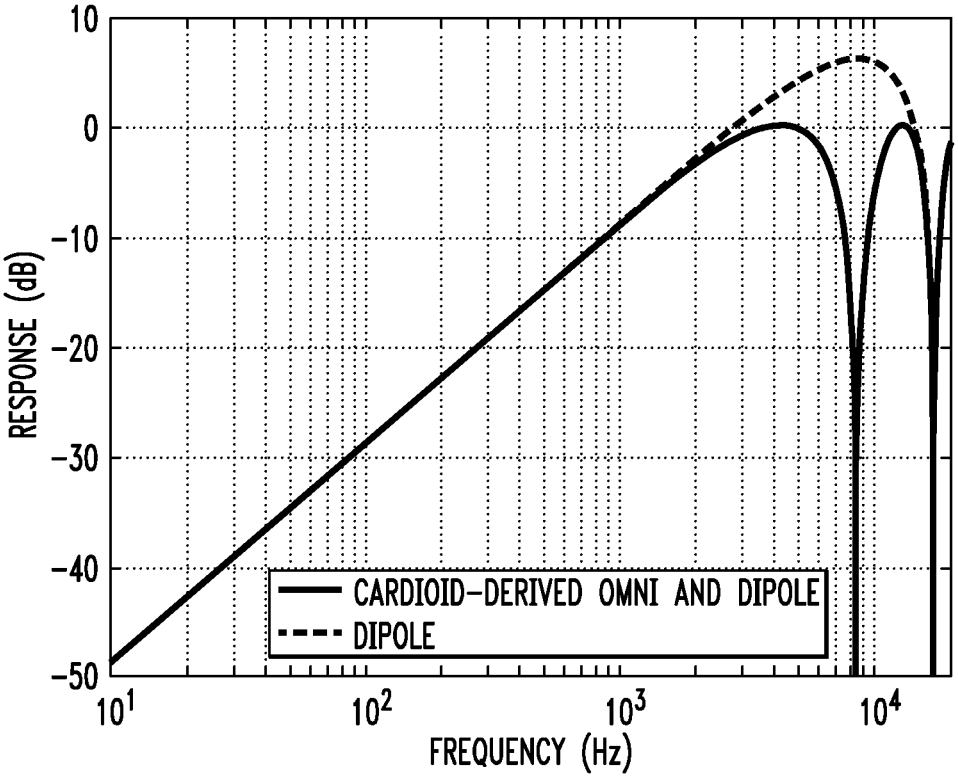
FIG. 5 shows the frequency responses for acoustic signals incident along the microphone pair axis for an omni-derived dipole signal, a cardioid-derived dipole signal, and a cardioid-derived omnidirectional signal.

FIG. 5 shows the frequency responses for acoustic signals incident along the microphone pair axis (θ=0°) for an omni-derived dipole signal, a cardioid-derived dipole signal, and a cardioid-derived omnidirectional signal. Note that the cardioid-derived dipole signal and the cardioid-derived omnidirectional signal have the same frequency response. In each case, the microphone-element spacing is 2 cm. At this angle, the zeros occur in the cardioid-derived dipole term at the frequencies where kd=2nπ, where n=0, 1, 2, . . . .

Diffractive Differential Beamformer

In real-world implementation design constraints, it is usually not possible to place a pair of microphones on the device such that a simple delay filter as discussed above can be used to form the desired cardioid base beampatterns. Devices like laptop computers, tablets, and cell phones are typically thin and do not support a baseline spacing of the microphones to support good endfire dual-microphone operation. As the inter-microphone spacing decreases, the commensurate loss in SNR (similar to small kr in spherical beamforming as shown in Equation (11)) and increase in sensitivity to microphone-element mismatch can severely limit the performance of the beamformer. However, it is possible to exploit the acoustic scattering and diffraction by properly placing the microphones on thin devices.

It is well known that acoustic diffraction and scattering can dramatically change the phase and amplitude differences between pressure microphones as the sound propagates around a device. The resulting phase and magnitude differences are also dependent on frequency and angle of incidence of the impinging sound wave. Acoustic diffraction and filtering is a complicated process, and a full closed-form mathematical solution is possible with only a few limited diffractive bodies (infinite cylinder, sphere, disk, etc.). However, at frequencies where the acoustic wavelength is much larger than the body on which the microphones are mounted, it is possible to make general statements as to how the magnitude and phase delay will change as a result of the diffraction and scattering of an impinging sound wave.

In general, at frequencies where the device body is much smaller than the acoustic wavelength, the amplitude differences will be small and the phase delay is typically (but not necessarily) a monotonically increasing function as the frequency increases (just like the on-axis phase for microphones that are not mounted on any device). The phase delay can depend greatly on the positions of the microphones on the supporting device body, the angle of sound incidence, and the geometric shape of the boundaries.

Figure 6:
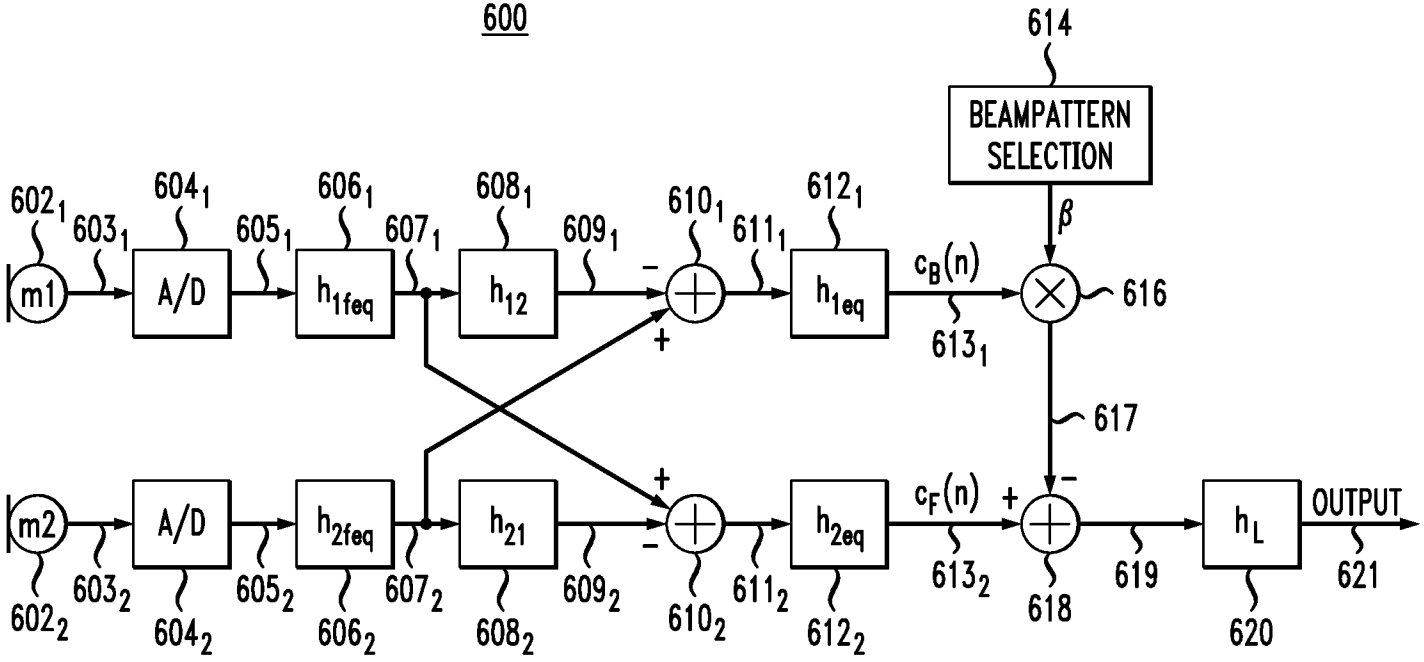
FIG. 6 is a block diagram of a differential microphone system having a pair of omnidirectional microphones mounted on different (e.g., opposite) sides of a device.

FIG. 6 is a block diagram of a differential microphone system 600 having a pair of omnidirectional microphones $\mathbf{602}_1$ and $\mathbf{602}_2$ mounted on different (e.g., opposite) sides of a device (not shown). The microphone signals $\mathbf{603}_1$ and $\mathbf{603}_2$ are respectively sampled by analog-to-digital (A/D) converters $\mathbf{604}_1$ and $\mathbf{604}_2$, and the resulting digitized signals $\mathbf{605}_1$ and $\mathbf{605}_2$ are respectively filtered by front-end matching filters $\mathbf{606}_1$ and $\mathbf{606}_2$ that enable compensation for mismatch between the microphones $\mathbf{602}_1$ and $\mathbf{602}_2$ for whatever reason. The front-end matching filters $\mathbf{606}_1$ and $\mathbf{606}_2$ apply transfer functions $h_{1feq}$ and $h_{2feq}$, respectively, that act to match the responses of the two microphones. The matching filters $\mathbf{606}_1$ and $\mathbf{606}_2$ are used to allow matching the pair of microphones to compensate for differences between the microphones and/or how they are acoustically ported to the sound field. These matching filters correct for the difference in responses between the microphones when a known sound pressure is at the microphone input ports.

The resulting equalized signals $\mathbf{607}_1$ and $\mathbf{607}_2$ are respectively applied to diffraction filters $\mathbf{608}_1$ and $\mathbf{608}_2$, which apply respective transfer functions $h_{12}$ and $h_{21}$, where the transfer function $h_{12}$ represents the effect that the device has on the acoustic pressure for a first acoustic signal arriving at microphone $\mathbf{602}_1$ along a first propagation axis and propagating around and through the device to microphone $\mathbf{602}_2$, and transfer function $h_{21}$ represents the affect that the device has on the acoustic pressure for a second acoustic signal arriving at microphone $\mathbf{602}_2$ along a second propagation axis and propagating around and through the device to microphone $\mathbf{602}_1$. The transfer functions may be based on measured impulse responses. For an adaptive beamformer, the first and second propagation axes should be collinear with the line passing through the two microphones, with the first and second acoustic signals arriving from opposite directions. Note that, in other implementations, the first and second propagation axes may be non-collinear. Diffraction filters $\mathbf{608}_1$ and $\mathbf{608}_2$ may be implemented using finite impulse response (FIR) filters whose order (e.g., number of taps and coefficients) is based on the timing of the measured impulse responses around the device. The length of the filter could be less than the full impulse response length but should be long enough to capture the bulk of the impulse response energy. Although the causes of the impact of the physical device on the characteristics of the acoustic signals are referred to as diffraction and scattering, it will be understood that, since the diffraction filters 608 are derived from actual measurements, the diffraction filters take into account any effects on the acoustic signals resulting from the device including, but not necessarily limited to, acoustic diffraction, acoustic scattering, and acoustic porting.

Subtraction node $\mathbf{610}_1$ subtracts the filtered signal $\mathbf{609}_1$ received from the diffraction filter $\mathbf{608}_1$ from the equalized signal $\mathbf{607}_2$ received from the matching filter $\mathbf{606}_2$ to generate a first difference signal $\mathbf{611}_1$. Similarly, subtraction node $\mathbf{610}_2$ subtracts the filtered signal $\mathbf{609}_2$ received from the diffraction filter $\mathbf{608}_2$ from the equalized signal $\mathbf{607}_1$ received from the matching filter $\mathbf{606}_1$ to generate a second difference signal $\mathbf{611}_2$. Equalization filters $\mathbf{612}_1$ and $\mathbf{612}_2$ apply equalization functions $h_{1eq}$ and $h_{2eq}$, respectively, to the difference signals $\mathbf{611}_1$ and $\mathbf{611}_2$ to generate the backward and forward base beampatterns $\mathbf{613}_1$ ($c_B(n)$) and $\mathbf{613}_2$ ($c_F(n)$). Measurements of the two transfer functions $h_{12}$ and $h_{21}$ made on cell phone and tablet bodies for on-axis sound for both the forward and backward directions have shown that it is possible to form the first-order cardioid base beampatterns $c_B(n)$ and $c_F(n)$ at lower frequencies. Equalizers $h_{1eq}$ and $h_{2eq}$ are post filters that set the desired frequency responses for the two output beampatterns.

Beampattern selection block 614 generates the scale factor β that is applied to the backward base beampattern 613$_1$ by the multiplication node 616. The resulting scaled signal 617 is subtracted from the forward base beampattern 613$_2$ at the subtraction node 618, and the resulting beampattern difference signal 619 is applied to output equalizer 620 to generate the output beampattern signal 621. The parameter β is used to control the desired output beampattern. To obtain the zero-order omnidirectional component, the parameter is set to β=−1, and to β=1 for the pressure differential dipole term. Output equalizer 620 applies an output equalization filter $h_L$ that compensates for the overall output beamformer frequency response. See U.S. Pat. Nos. 8,942,387 and 9,202,475, the teachings of which are incorporated herein by reference in their entirety.

Although the beampattern selection block 614 can generate β=−1 for the omni component or β=1 for the dipole term, the beampattern selection block 614 can also generate values for β that are between −1 and 1. Positive values of β can be used to control where the single conical null in the beampattern will be located. For a diffuse sound field, the directivity index (DI), which is the directional gain in a diffuse noise field for a desired source direction, reaches a maximum (i.e., maximum DI is 6 dB) for a two-element beamformer when β is 0.5, where the maximum DI is 6 dB. The front-to-rear power ratio is maximized (i.e., DI is 5.8 dB) when β is about 0.26.

When there is wind noise, self-noise (e.g., low external acoustic energy), or some other type of noise not associated with the soundfield (like mechanical structural noise or noise from someone touching a microphone input port), β may be selected to be negative. If β is between 0 and −1, then the beampattern will have a "subcardioid" shape that does not have a null. As β approaches −1, the beampattern moves toward the omnidirectional pattern that is achieved when β=−1. If there is a relatively small amount of noise, then some advantages in beamformer gain can be achieved by selecting a negative value for β other than −1.

Note that, in certain implementations, the output filter 620 can be embedded into the front-end matching filters 606$_1$ and 606$_2$. For certain implementations in which the microphones 602$_1$ and 602$_2$ are sufficiently matched, the front-end matching filters 606$_1$ and 606$_2$ can be omitted. For certain implementations, such as the symmetric case where the transfer functions $h_{12}$ and $h_{21}$ are substantially equal, the equalization filters 612$_1$ and 612$_2$ can be omitted.

As the sound wave frequency increases, at some frequency, the smooth monotonic phase delay and amplitude variation impact of the device body on the diffraction and scattering of the sound begins to deviate from a generally smooth function into a more-varying and complex spatial response. This is due to the onset of higher-order modes becoming significant relative to the lower-order modes that dominate the response at lower frequencies where the wavelength is much larger than the device body size. The term "higher-order modes" refers to the higher-order spatial response terms. These modes can be decomposed as orthogonal eigenmodes in a spatial decomposition of the sound field either through a closed-form expansion, a spatial singular value decomposition, or a similar orthogonal decomposition of the sound field. These modes can be also thought of as higher-order components of a closed-form or series approximation of the acoustic diffraction and scattering process.

As noted above, closed-form solutions for diffraction and scattering are not usually available for arbitrary diffracting body shapes. Instead, approximations or numerical solutions based on measurements or computer models may be used. These solutions can be represented in matrix form where the eigenvectors are representative of an orthonormal (or at least orthogonal) modal spatial decomposition of the scattering and diffraction physics. The eigenvectors represent the complex spatial responses due to diffraction and scattering of the sound around the body of the device. Spatial modes can be sorted into orders that move from simple smooth functions to ones that show increasing variation in their equivalent spatial responses. Smoothly fluctuating modes are those associated with low-frequency diffraction and scattering effects, and the rapidly varying modes are representative of the response at frequencies where the wavelength is smaller than or similar in size to the device body. Decomposition of the sound field into underlying modes is a classic analytical approach and is related to previous work by Meyer and Elko on the use of spherical harmonics and a rigid sphere baffle and brings up a general approach that could be utilized to obtain the desired first-order B-format and higher-order decompositions of the sound field that can be used as input signals to a general spatial playback system. See U.S. Pat. No. 7,587,054, the teachings of which are incorporated herein by reference in their entirety. The general approach based on using all microphones on a device to implement spatial decomposition is discussed below.

The placement of microphones on the device surface does not have to be symmetric. There are, however, microphone positions that are preferential to others for improved operation. Symmetrical positioning of microphone pairs on opposing surfaces of a device is preferred since that will result, for each microphone pair, in the two back-to-back beams that are formed having similar output SNR and frequency responses. A microphone pair is said to be symmetrically positioned when the microphones are located on opposite sides of a device along a line that is substantially normal to those two sides. A possible advantageous result of the process of diffraction and scattering can be obtained when the microphone axis (i.e., the line connected a pair of microphones) is not aligned to the normal of the device. The angular dependence of scattering and diffraction has the effect of moving the main beam axis towards the axis determined by the line between the two microphones. Another advantage that results from exploiting diffraction and scattering is that the phase delay between the microphone pairs can be much larger than the phase delay between the two microphones in an acoustic free field as determined by the line connecting the two microphones. The increase in the phase delay can result in a large increase in the output SNR relative to what would be obtained without a diffracting and scattering body between the microphone pairs.

The two back-to-back equalized beamformers that are derived as described above can then be used to form a general beampattern by combining the two output signals as described above using cardioid beampatterns. One can also use the above measurement to define where the position of the null is in the first-order differential beampattern. If only one directional beam is desired, then one could save computational cost and form only the desired beampattern. One could also store multiple transfer function measurements and then enable multiple simultaneous beams and/or the ability to select the desired beampattern.

As used herein, the term "beampattern" is used interchangeably to refer both to the spatial response of a beamformer that generates an audio signal as well as to the audio signal itself. Thus, a signal-processing system that generates an output audio signal having a particular beampattern may be said to generate that beampattern.

Gradient Differential Beamformer and B-Format

The previous discussion has shown that, by appropriately combining the outputs of back-to-back cardioid signals or, equivalently, the combination of an omnidirectional microphone and a dipole microphone with matched frequency responses, any general first-order pattern can be obtained. However, the main lobe response is limited to the microphone pair axis since the pair can deduce the scalar pressure differential only along the pair axis. It is straightforward to extend the one-dimensional differential to 3D by measuring the true field gradient and not just one component of the gradient.

Fortunately, this problem can be effectively dealt with by increasing the number of microphones used to derive the three orthogonal dipole signals (that are also the first-order spherical harmonics) and the omnidirectional pressure signal (i.e., the zeroth-order spherical harmonic) (recall Equation (9)). As mentioned previously, computing a B-format set of signals requires a minimum of four "closely spaced" pressure signals, where "closely spaced" means that the inter-microphone effective distances are smaller than the shortest acoustic wavelength of interest (e.g., <4 cm for a specified high-frequency value of 8 kHz). In preferred embodiments, the inter-microphone effective distances are smaller than one-half the shortest acoustic wavelength of interest (e.g., <2 cm for a specified high-frequency value of 8 kHz). Vectors that are defined by the lines that connect the four spatial locations must span the three-dimensional space so that the spatial acoustic pressure gradient signals can be derived (in other words, all microphones are not coplanar).

More microphones can be used to increase the accuracy and SNR of the derived spatial acoustic derivative signals. For instance, a simple configuration of six microphones spaced along the Cartesian axes with the origin between each orthogonal pair allows all dipole and monopole signals to have a common phase center (meaning that all four B-Format signals are in phase relative to each other) as well as increasing the resulting SNR for all signals. However, it is not required that all orthogonal pairs have a common phase center, but it is desirable to have the phase centers of each pair relatively close to each other (e.g., the effective spacing between phase centers (i.e., the inter-phase-center effective distance) should be less than the wavelength, and preferably less than ½ of the wavelength, at a specified high-frequency value where precise 3D spatial control is required).

As mentioned above, for the microphone pairs and for the phase center offsets for the different axes, it was recommended that the inter-microphone and the inter-phase-center effective distances should be less than the wavelength, and preferably less than ½ the wavelength, of the specified high-frequency value. The frequency range for control over the B-format signal generation is selected by a designer or a user of an audio signal-processing system. For human speech, the upper frequency for wide-band communication is around 8 kHz. An 8 kHz acoustic signal propagating at 343 m/s has a wavelength of approximately 4 cm and therefore the inter-microphone and the inter-phase-center effective distances should be less than 4 cm, and preferably less than 2 cm, for this specified high-frequency value. Note that sound diffraction around the device delay can result in an effective distance that is larger than the mechanical physical spacing between the microphones.

As used herein, the term "effective distance" between two different locations refers to the distance that a free propagating sound wave would travel with the same phase delay as an acoustic signal arriving at those two different locations. The effective distance can be calculated as the phase delay times the speed of sound divided by the frequency. When two (or more) microphones are used to generate an audio signal corresponding to a first-order beampattern in a particular direction, the effective distance for those microphones is relative to an acoustic signal arriving at those microphones along that particular direction. Note that the effective distance may depend on the frequency of the acoustic signal, especially when the microphones are located on different sides of the device body. In that case, the effective distance between the microphones can decrease as acoustic frequency increases, with the effective distance approaching, but never reaching, a lower limit corresponding to the so-called "line distance" that would be traversed by a hypothetical acoustic signal travelling along the surface of the device body from a corresponding incident acoustic wave to the more-distant microphone(s).

Human hearing for spatial audio is based on binaural pickup by two ears. The spatial representation for individual sources can be represented by the Binaural Room Impulse Response (BRIR) function that describes the transfer functions from the source to each ear. BRIR functions have been measured and derived from analytic models of sound propagating around the listener's head and used for binaural headphone playback of spatial audio signals. For B-format signals, one can derive first-order approximations to the true BRIR function (which are technically infinite-order but can be truncated due to human perceptual limitations). It is known that, for frequencies above 6-8 kHz, the accuracy of B-format-derived BRIR functions are not required for perceptual spatial acuity of sound fields that are complex (sound fields that have multiple sources and reverberation). See, e.g., F. Menzer, C. Faller, and H. Lissek, "Obtaining Binaural Room Impulse Responses From B-Format Impulse Responses Using Frequency-Dependent Coherence Matching", IEEE Transactions on Audio, Speech & Language Processing, Vol. 19, 2010. pp 396-405, the teachings of which are incorporated herein by reference in their entirety. Thus, setting the specified high-frequency value for accurate B-format transductions to 8 kHz could be sufficient for most types of sound sources and sound fields that have a mixture of multiple sound sources and reverberation.

The impact of diffraction is much larger when the acoustic wavelength is smaller than the size of the device body in which the microphones are mounted. It is therefore possible to use the natural shadowing of the device body to derive appropriate signals that are consistent with the B-format signals at frequencies above the specified high-frequency value where, due to spatial aliasing, the derived B-format signals would not be a good match to the desired B-format spatial responses. At such high frequencies, the B-format processing might not produce accurate B-format results. In particular, the beampatterns might not look like the ideal, desired zeroth-order and first-order beampatterns. Instead of having no null in the case of the zeroth-order beampattern and one null in the case of the first-order beampatterns, the resulting beampatterns may have multiple nulls that change in angle with frequency. Nevertheless, it may still be acceptable to allow the spatially aliased B-format signals to be used at higher frequency signals (>6 kHz for instance) even if the beampatterns will be distorted relative to the ideal, desired B-format beampatterns. At these higher frequencies, the B-format beamformer filters could be derived to fulfill constraints in only specific directions and not at all spatial angles as achieved at lower frequencies when the device is smaller than the acoustic wavelength. Since the overall beampattern cannot be controlled (due to the lack of the necessary degrees of freedom to control the beamformer where degrees of freedom are a direct function of the number of microphones), a null can still be placed in space (independent of frequency). As such, when the signals are spatially aliased, at least a null can be maintained in the proper plane so that the null positions of the underlying beampatterns can be matched within what is physically controllable. Sufficient pairs of microphones will enable a null to be placed in a specified direction. If the scattering and diffraction are asymmetrical, then placing a null in one direction might not place a null in the symmetric direction.

Implementation

FIGS. 7A-7D show two of the many different possible microphone array configurations to obtain B-format signals on a mobile device such as a cell phone or tablet, where the mobile device has a general parallelepiped shape. A parallelepiped is a polyhedron with six faces (aka sides), each of which is a parallelogram. The mobile devices shown in FIGS. 7A-7D are said to have a "general" parallelepiped shape because some of the transitions between faces are curved.

Figures 7A, 7B, 7C, 7D:
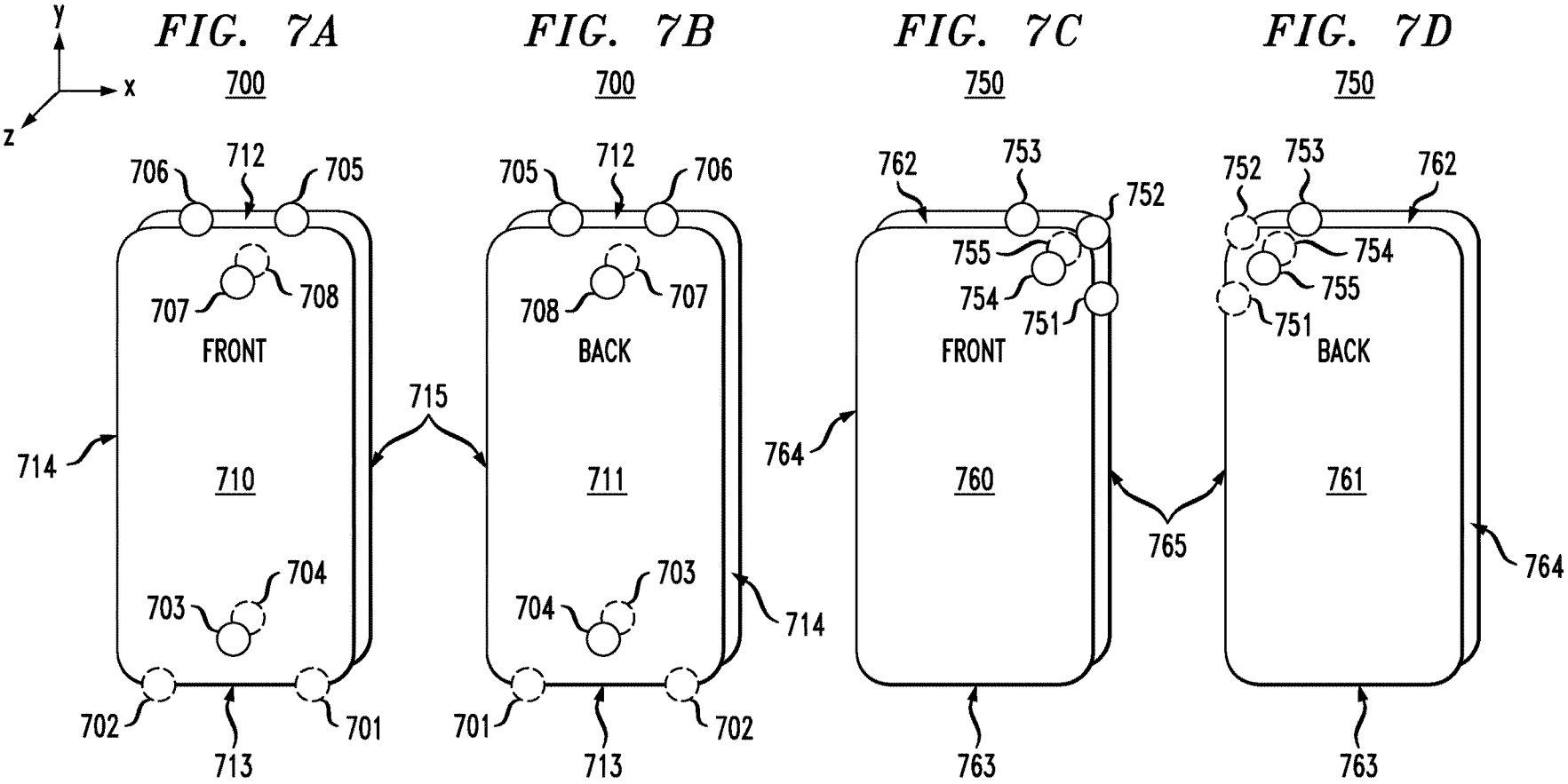
FIGS. 7A and 7B show front and back perspective views, respectively, of a mobile device having an eight-microphone array.
FIGS. 7C and 7D show front and back perspective views, respectively, of a mobile device having a five-microphone array.

FIGS. 7A and 7B show front and back perspective views, respectively, of a mobile device 700 having an eight-microphone array having microphones 701 to 708. The mobile device 700 has six sides: front side 710, back side 711, top side 712, bottom side 713, left side 714, and right side 715. Microphones 701 and 702 on the bottom side 713 lie on a line parallel to the x-axis shown in the figures. Similarly, microphones 705 and 706 on the top side 712 also lie on a line parallel to the x axis. Microphones 703 and 704 are on the front side 710 and the back side 711 of the device, respectively, and lie on a line that is parallel to the z axis. Similarly, microphones 707 and 708 are also on the front side 710 and the back side 711, respectively, and lie on a line that is parallel to the z axis. Preferably, the x-axis coordinates of microphones 703 and 704 are equal to the x-axis coordinate of the center point between microphones 701 and 702. Similarly, the x-axis coordinates of microphones 707 and 708 are preferably equal to the x-axis coordinate of the center point between microphones 705 and 706.

For most practical cases, only the four microphones 705-708 at the top of the device are used to derive the B-format signals. The x-axis component can be obtained by forming an x-axis dipole signal using only microphones 705 and 706, while the z-axis component can be obtained by forming a z-axis dipole signal using only microphones 707 and 708. The y-axis component can be obtained using any three or all four microphones 705-708. For example, the audio signals from microphones 705 and 706 can be averaged to obtain an effective microphone signal that has a pressure response with a phase center midway between the two microphones. This averaged signal can then be combined with the audio signal from either microphone 707 or microphone 708 (or a second effective microphone signal corresponding to a weighted average of the audio signals from microphones 707 and 708) to obtain a dipole signal that has a pressure response that is aligned with the y axis.

It should be noted that all three computed dipole component signals can have different sensitivities as well as different frequency responses, and that these differences can be compensated for with an appropriate equalization post-filter on each dipole signal. Similarly, the zero-order pressure term will also need to be compensated to match the responses of the three-dipole signals. For a practical implementation, these post-filters are extremely important. Moreover, for best performance, the post-filters are "complex," such that both amplitude and phase are equalized to match the amplitude and phase of the omnidirectional response along the axes.

Note also that, in FIGS. 7A and 7B, the phase centers of the different signals are physically in different locations. The phase center offset between all signals will result in an angular-dependent response of the beamformer that is a function of the distance between the phase centers.

The zero-order (omni) term can be computed as a pressure average over some or all of the microphones 705-708 or can even be formed from a single microphone. When using all four microphones 705-708, the omni component will advantageously provide a phase center that is "the closest" possible to the phase centers of the x, y, and z axes defined by microphones 705-708. Any other omni component formed from fewer microphones will be a poorer center to the y and z axes. Choosing a "good" phase center will help when the components are equalized for matching.

Similar processing can also be performed using the bottom microphone sub-array consisting of microphones 701-704 so that one could have the output of two B-format signals with a spatial offset in their respective phase centers. This arrangement might be useful in rendering a different spatial playback when using the device in landscape mode (e.g., with the mobile device 700 rotated by 90 degrees about the z axis shown in FIG. 7A) since one could exploit the impact of having a binaural signal with angularly dependent phase delay, which may improve the spatial playback quality of the sound field when rendering the playback signal. Alternatively, all eight microphones 701-708 could be used to generate a single B-format signal having greater SNR.

In some cases, the signal processing for lower frequencies can be based on one set of microphones, while the signal processing for higher frequencies can be based on a different set of microphones. For low frequencies where the wavelengths are much larger than the dimensions of the device, using microphones that are spaced as far apart as possible is preferred (due to output signal level). As the frequency increases, it is preferable to use microphones that are closer together to satisfy the differential processing requirement that the microphones be effectively spaced apart by less than one wavelength, and preferably less than ½ wavelength at a specified high-frequency value (e.g., 8 kHz). In one possible implementation, the transition from using farther microphones to using closer microphones occurs at or near the frequency where the farther microphones are a wavelength or more apart. In general, SNR and estimation of the pressure field spatial gradients can both be improved by increasing the number of microphones.

FIGS. 7C and 7D show front and back perspective views, respectively, of a mobile device 750 having a five-microphone array having microphones labeled 751 to 755. Mobile device 750 has six sides 760-765 that correspond to the six sides 710-715 of mobile device 700 of FIGS. 7A and 7B. In this configuration, microphone 751 (on right side 765) and microphone 752 (at the transition between the top side 762 and the right side 765) lie on a line substantially parallel to the y axis, while corner microphone 752 and microphone 753 (on top side 762) lie on a line substantially parallel to the x axis, and microphone 754 (on front side 760) and microphone 755 (on back side 761) lie on a line that is parallel to the z axis.

Here, the x-axis component can be obtained by forming an x-axis dipole signal using only microphones 752 and 753, the y-axis component can be obtained by forming a y-axis dipole signal using only microphones 751 and 752, and the z-axis component can be obtained by forming a z-axis dipole signal using only microphones 754 and 755.

One potential advantage for this microphone configuration is that the y-axis microphones are on the same side of the device 750, and therefore the diffraction effects would be smaller than for the arrangement shown in FIGS. 7A-7B. The matching of the spatial response of the dipole pairs can therefore be better, and the differences between the pairs can be smaller in terms of frequency response (e.g., more-similar correction post-filters imply better matching in both spatial and frequency responses as a function of angle of incidence).

One can further "tune" the design such that the z-axis pair (microphones 754 and 755) can be positioned so that their effective diffraction spacing is close to that of the x and y pairs and thus make the unprocessed dipole signal SNR and frequency response better matched before post-processing. By matching the three orthogonal raw dipole responses as close as possible in terms of sensitivity and response, the outputs can be of similar SNR, which is highly desirable. Again, the zero-order (omni) term can be computed as a pressure average over some or all of the microphones or can even be formed from a single microphone. Furthermore, averaging of microphones can be done differently depending on frequency. For example, it could be advantageous to use more or even all microphones for low frequencies while using fewer or even just one microphone for high frequencies. In one possible implementation, the transition from using more microphones to using fewer microphones occurs at or near the frequency where the inter-microphone effective distance is less than half a wavelength.

Although device 750 of FIGS. 7C-7D has the configuration of five microphones 751-755 located at the upper left corner of the device (facing the front side 760), analogous five-microphone configurations could alternatively be located at any of the other three corners of the device. Furthermore, analogous to device 700 of FIGS. 7A-7B, a device similar to device 750 could be configured with multiple five-microphone configurations at multiple different corners to generate multiple B-format signals with spatial offset.

Although FIGS. 7A-7D show two different configurations of microphones that can be used to generate output audio signals corresponding to three orthogonal first-order beampatterns, they are, of course, not the only two such configurations. In general, preferred configurations would have the microphones clustered such that the inter-microphone effective distance between any two microphones used to generate an output audio signal corresponding to a first-order beampattern as well as the inter-phase-center effective distance between the phase centers of different pairs of microphones used to generate pairs of those output audio signals are both less than the acoustic wavelength, and preferably less than one half of the acoustic wavelength for the specified high-frequency value.

Referring again to FIGS. 7A and 7B, because microphones 705 and 706 are both located along side 712 of mobile device 700, for the x axis, the inter-microphone effective distance is substantially equal to the point-to-point distance between microphones 705 and 706. The inter-microphone effective distance for the y axis will be substantially equal to the point-to-point distance between (i) the "effective microphone" located midway between microphones 705 and 706 and (ii) either microphone 707 or microphone 708 or the "effective microphone" located midway between microphones 707 and 708, depending on which microphone signals are used to generate the output audio signal corresponding to the first-order beampattern in the y direction. Because microphones 707 and 708 are symmetrically located on different sides of the mobile device 700, the inter-microphone effective distance for the z axis will be longer than the point-to-point distance between those two microphones and will be a function of the line distance between them for an acoustic signal incident along the z axis, where the z-axis line distance between microphones 707 and 708 is substantially equal to the thickness of the mobile device 700 plus the distance from the top side 712 of the mobile device 700 to either microphone 707 or 708 in the y-axis direction.

The four microphones 705-708 have three different phase centers for the three different axes x, y, and z. For the x axis, the phase center is the midpoint between microphones 705 and 706. For the y axis, the phase center is substantially the midpoint between (i) the midpoint between microphones 705 and 706 and (ii) the midpoint between microphones 707 and 708. For the z axis, the phase center is the midpoint along the line-distance path between microphones 707 and 708.

The inter-microphone and inter-phase-center effective distances for the microphones 701-704 are analogous to those for the microphones 705-708. Note that, for the x-axis, the effective distance between (i) the x-axis phase center for microphones 701-704 and (ii) the x-axis phase center for microphones 705-708 is substantially zero. Similarly, for the z-axis, the effective distance between (i) the z-axis phase center for microphones 701-704 and (ii) the x-axis phase center for microphones 705-708 is also substantially zero. For the y-axis, however, the effective distance between (i) the y-axis phase center for microphones 701-704 and (ii) the y-axis phase center for microphones 705-708 is relatively large, which enables the two different sets of microphones to be used to generate two binaural (or stereo) sets of output audio signals.

Referring now to FIGS. 7C and 7D, because microphone 752 is located on the transition between the right side 765 and the top side 762 of mobile device 750 (as shown in FIG. 7C) and because microphones 751 and 753 are respectively located on those right and top sides, for the y axis, the inter-microphone effective distance is substantially equal to the point-to-point distance between microphones 751 and 752 and, for the x axis, the inter-microphone effective distance is substantially equal to the point-to-point distance between microphones 752 and 753. Because microphones 754 and 755 are located on different sides of the mobile device 750, the inter-microphone effective distance for the z axis will be longer than the point-to-point distance between those two microphones and will be a function of the line distance between them for an acoustic signal incident along the z axis (e.g., the thickness of the mobile device 750 plus the shorter of the distances from the top and right sides of the mobile device to either microphone 754 or 755).

The inter-phase-center effective distances for the microphones 751-755 of FIGS. 7C and 7D are analogous to the inter-phase-center effective distances for the microphones 705-708 of FIGS. 7A and 7D.

Figure 8:
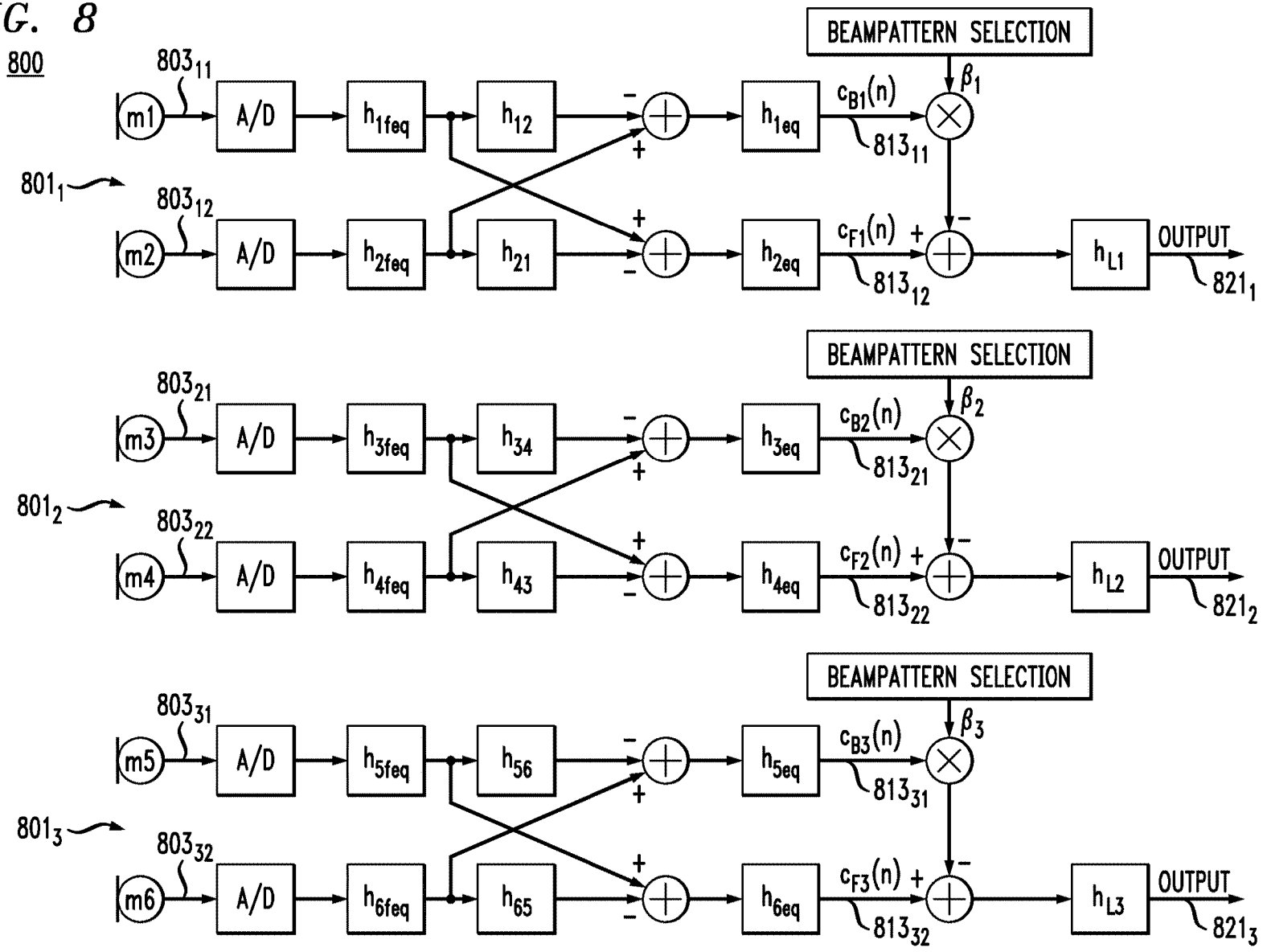
FIG. 8 shows a first-order B-format audio system comprising three audio subsystems.

FIG. 8 shows a first-order B-format audio system 800 comprising three audio subsystems $\mathbf{801}_1$-$\mathbf{801}_3$, each of which is analogous to the differential microphone system 600 of FIG. 6. Audio system 800 can be used to process audio signals from three orthogonal pairs of microphones to generate a B-format audio output comprising mutually orthogonal x, y, and z component dipole signals $\mathbf{821}_1$-$\mathbf{821}_3$ and an omnidirectional signal. The x, y, and z component signals $821_1$-$821_3$ can be generated by setting the corresponding β values to 1. The omnidirectional signal can be generated using the omni signal from any one of the microphones of audio system 800 or by combining (e.g., averaging) multiple omni signals from two or more of the microphones or by generating an omni signal using one of the three audio subsystems 801 with the corresponding β value set to −1 or by combining (e.g., averaging) the omni signals from two or more of the subsystems 801. The resulting mutually orthogonal x, y, and z component dipole signals and the omnidirectional signal can then be combined (e.g., by weighted summation) to form any desired first-order beampattern steered to any desired direction.

For the microphone configuration of FIGS. 7A-7B, the two microphone signals from microphones 701 and 702 can be applied as the two input microphone signals 803 to the first audio subsystem $801_1$ to generate the x-component signal $821_1$. Similarly, the two microphone signals from microphones 703 and 704 can be applied as the two input microphone signals 803 to the third audio subsystem $801_3$ to generate the z component signal $821_3$. For the y component signal $821_2$, the microphone signals from microphones 701 and 702 can be combined (e.g., as a weighted average) to form a first effective microphone signal to be applied as first input microphone signal 803 to the second audio subsystem $821_2$. The second input microphone signal 803 to the second audio subsystem $821_2$ can be either (i) the microphone signal from microphone 703 or (ii) the microphone signal from microphone 704 or (ii) a second effective microphone signal formed by combining (e.g., as a weighted average) the microphone signals from microphones 703 and 704. Analogous processing can be applied to the microphone signals from microphones 705-708 to generate additional x, y, and z component signals that can be used in combination with or instead of the component signals formed using microphones 701-704.

For the microphone configuration of FIGS. 7C-7D, the two microphone signals from microphones 752 and 753 can be applied as the two input microphone signals 803 to the first audio subsystem $801_1$ to generate the x component signal $821_1$. Similarly, the two microphone signals from microphones 751 and 752 can be applied as the two input microphone signals 803 to the second audio subsystem $801_2$ to generate they component signal $821_2$. And the two microphone signals from microphones 754 and 755 can be applied as the two input microphone signals 803 to the third audio subsystem $801_3$ to generate the z component signal $821_3$.

Note that one or more of the microphones can be used in multiple pairs as would be the case for the microphone arrangement shown in FIGS. 7C-7D, where microphone 752 is used for both the x and y component signals.

For the B-format dipole outputs, $\beta_i=1$, while the zero-order component can be the average of one or more of the three zero-order components (obtained by using $\beta_i=-1$). Note that, here too, $\beta_i$ can have values between −1 and 1.

In certain implementations, all of the processing shown in FIG. 8 is implemented in the device on which the microphones are mounted. In other implementations, some or all of the processing shown in FIG. 8 may be implemented in a system other than the device on which the microphones are mounted. For example, in a particular implementation, the forward and backward base beampatterns 813 are generated on the device and then transmitted (e.g., wirelessly) from the device to an external system that can store that data for subsequent and multiple instances of further processing using different scale factors $\beta_i$.

While FIG. 8 depicts an audio system 800 having three mutually orthogonal subsystems $801_1$-$801_3$, in other possible implementations, the three subsystems need not all be mutually orthogonal (as long as they are not all co-planar and no two of them are parallel). If the outputs 821 from the audio system are not in orthogonal directions (i.e., the outputs are not mutually orthogonal), then the outputs can be appropriately combined to generate a set of mutually orthogonal signal outputs. One straightforward way to implement this orthogonalization process is to compute three (non-mutually orthogonal) dipole signals 821 using audio system 800 and then apply those dipole signals to appropriate steering filters (that are based on the known directions of the dipole outputs and the axes of a Cartesian coordinate system) to generate a set of mutually orthogonal dipole signals aligned with the x, y, and z axes. It is also possible to use non-mutually orthogonal outputs 821 that are not dipole beampatterns but rather combinations of dipole and omnidirectional beampatterns to compute a set of orthogonal beampattern outputs using appropriate filtering. Furthermore, it is also possible to have a device with only two non-parallel subsystems 801 that span only two of the three dimensions. Such a device can be implemented with as few as three microphones, where one of the microphones is used in both subsystems.

When used herein to refer to directions, the term "orthogonal" implies that the directions are at right angles to one another. Thus, the x, y, and z axes of a Cartesian coordinate system are mutually orthogonal, and three pairs of microphones, each pair configured parallel to a different Cartesian axis, are said to be mutually orthogonal. When used herein to refer to beampatterns, the term "orthogonal" implies that the spatial integration of the product of one beampattern with another different beampattern is zero (or at least substantially close to zero). Thus, the four beampatterns (i.e., x, y, and z component dipole beampatterns and one omnidirectional beampattern) of a set of first-order B format ambisonics are mutually orthogonal. Mutually orthogonal beampatterns are also referred to as eigen or modal beampatterns.

While the previous development has been focused on the first-order spherical harmonic decomposition of the incident sound field (B-Format signals), it is possible that more microphones could be used to resolve higher-order spherical harmonics. For Nth-order spherical harmonics, the minimum number $N_{min}$ of microphones is given by Equation (21) as follows:

$$N_{min}=(N+1)^2, \tag{21}$$

where N is the highest desired order. Thus, for second-order spherical harmonics, the minimum number of microphones is nine, sixteen for third-order, and so on. The next section discusses the concept of using all microphones simultaneously to derive a practical implementation of first- and higher-order beamformers.

General Beamformer Decomposition Approach

As mentioned earlier, it is also possible to form a general decomposition of the incident sound field by using all microphones and not just pairs or simple combinations of pairs of microphones to obtain a set of desired modal beampatterns. This approach has been used for a spherical microphone array where the spherical geometry led to a relatively simple and elegant way to obtain the desired "eigenbeam" modal beampatterns. For a more-general diffractive case where the geometry does not fit into one of the separable coordinate systems to enable a closed-form solution, one can use a least-squares or other approximate numerical beamformer design to best resolve the desired eigenbeams for further processing or for the natural representation that allows for easy post-processing manipulation that may be in a standard format like the natural spherical harmonic expansion.

Figure 9:
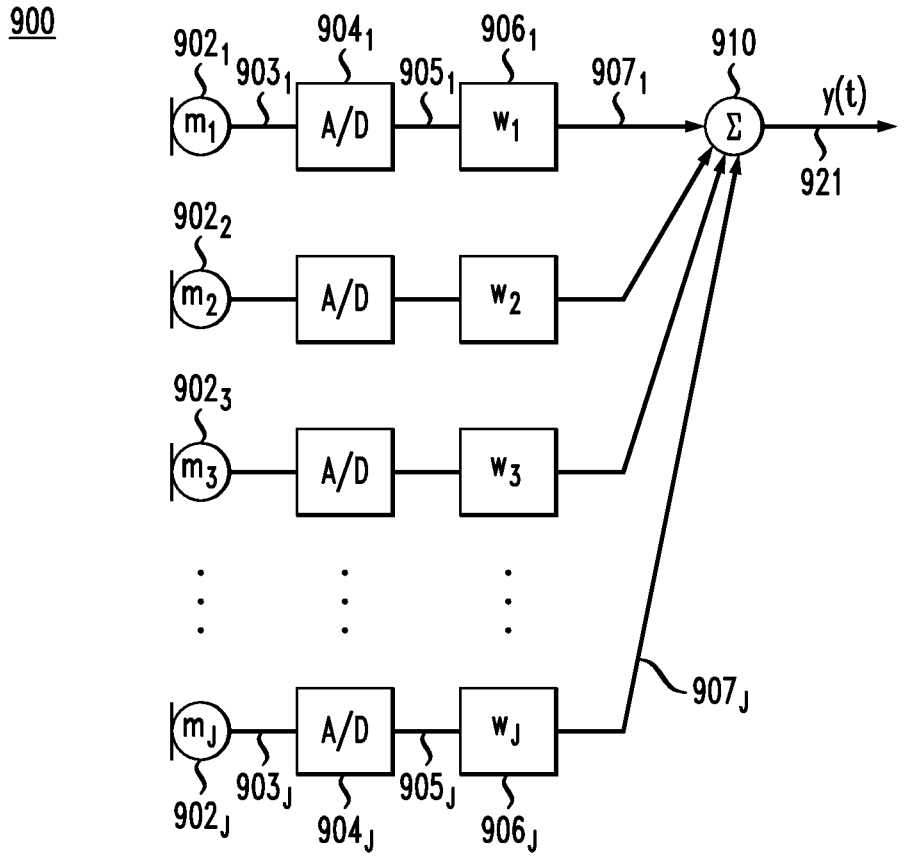
FIG. 9 is a block diagram of a general filter-sum beamformer having J(omni) microphones.

FIG. 9 is a block diagram of a general filter-sum beamformer 900 having J (omni) microphones $\mathbf{902}_1$-$\mathbf{902}_J$ that can be used to implement the desired general eigenbeam beamformers, where the J microphones are suitably distributed on the sides of a parallelepiped device (not shown). The microphone signals $\mathbf{903}_1$-$\mathbf{903}_J$ are first digitized by corresponding analog-to-digital (A/D) converters $\mathbf{904}_1$-$\mathbf{904}_J$ and then fed to a set of finite impulse response (FIR) weighting filters $\mathbf{906}_1$-$\mathbf{906}_J$, each containing M taps, that filter the digitized incoming microphone signals $\mathbf{905}_1$-$\mathbf{905}_J$. Other filter structures such as infinite-impulse response (IIR) filters or a combination of IIR and FIR filters could also be used. The filtered signals $\mathbf{907}_1$-$\mathbf{907}_J$ are then summed at summation node 910 to form a particular eigenbeam beampattern signal 921. Different eigenbeams can be formed by repeating the signal processing using different, appropriate instances of the weighting filters $\mathbf{906}_1$-$\mathbf{906}_J$. Note that, if the microphone signal $\mathbf{903}_i$ from a particular microphone $\mathbf{902}_i$ is not needed to generate a particular eigenbeam beampattern signal 921, then the corresponding weighting filter $\mathbf{906}_i$ could be set to 0.

For a generic set of J microphones $\mathbf{902}_1$-$\mathbf{902}_J$, for each of the three non-planar directions, the average inter-microphone effective distance for the microphones and, for each pair of the three non-planar directions, the average inter-phase-center effective distance for the microphones should be less than one wavelength, and preferably less than one-half wavelength, at a specified high-frequency value (e.g., 8 kHz). One possible way to determine the average inter-microphone effective distance is to compute the area of the device body that is spanned by the microphones, divide that area by the number of microphones, and then take the square root of the result. Note that it is preferable to have the microphones uniformly spaced over whatever region of the device body includes the microphones.

Finding the "best" filter weights that result in a spatial response (beampattern) that matches a desired response involves many, independent diffraction measurements around the device. It is preferable to have a somewhat uniform sampling of the spherical angular space. The measured diffraction response, relative to the acoustic pressure at a selected spatial reference point or the actual broadband signal that is used to insonify the device for the diffraction transfer function measurement, is used to build a matrix of directional diffraction measurements. The resulting diffraction measurement data matrix is then used with an optimization algorithm to find the filter weights that best approximate a set of desired eigenbeam beampatterns. When these optimum weights are applied to measurement diffraction matrix, the output beampattern is an approximation of the desired eigenbeam beampattern.

A unique set of weights is designed for each desired eigenbeam beampattern as a function of frequency. Thus, if L diffractive impulse response measurements are made around the device with J microphones, then the diffraction data matrix is of size L*J for each frequency. It should be noted that, typically, L>>J so that the solution for the optimum filter weights is for an overdetermined set of equations.

FIG. 9 shows an audio system 900 that generates a discrete-time scalar output 921 (y(k)) for a device having J microphones $\mathbf{902}_1$-$\mathbf{902}_J$ ($m_1$-$m_J$) and a filter-sum beamformer having J FIR weighting filters $\mathbf{906}_1$-$\mathbf{906}_J$ ($w_1$-$w_J$) and a summation node 910. Assume a unit-amplitude plane wave incident on the device at the spherical angle ($\theta_0$,$\phi_0$). The discrete-time scalar output y(k) can then be written as the sum of the convolution of each discrete-time scalar microphone signal vector $m_i(k)$ of length M with a different FIR filter $w_i$ having a unique weight vector $w_i$ of length M according to Equation (22) as follows:

$$y(k)=w^H m(k), \tag{22}$$

where H represents the Hermitian conjugate matrix operator and the overall filter weight vector w of length J*M is defined as a set of J concatenated FIR filter weight vectors $w_i$, each of length M, according to Equation (23) as follows:

$$w=[w_1,w_2,\ldots,w_J]^T. \tag{23}$$

where T is the transpose matrix operator. The i-th filter weight vector $w_i$ is given according to Equation (24) as follows:

$$w_i(k)=[w_i(1),w_i(2),\ldots,w_i(M)],i=1,J \tag{24}$$

Similarly, the overall microphone input signal vector m(k) can be written according to Equation (25) as follows:

$$m(k)=[m_1(k),m_2(k),\ldots,m_J(k)]^T, \tag{25}$$

where the overall microphone vector m(t) contains the J concatenated microphone signal slices of M samples each from the incident acoustic signal, where the i-th microphone signal $m_i(k)$ is given according to Equation (26) as follows:

$$m_i(k)=[m_i(k),m_i(k-1),\ldots,m_i(k-M-1)], \tag{26}$$

For simplicity and without loss of generality, we can convert to the frequency domain and define the diffraction response function to a plane wave from the spherical angles as the vector d. The frequency-domain output $\tilde{b}_i(\theta,\phi,\omega)$ of the i-th beamformer can be written according to Equation (27) as follows:

$$\tilde{b}_i(\theta,\phi,\omega)=d^H(\theta,\phi,\omega)h_i(\omega), \tag{27}$$

where the diffraction response function (i.e., the microphone output signal vector) $d(\theta, \phi, \omega)$ is given by Equation (28) as follows:

$$d(\theta,\phi,\omega)=[\alpha_1(\theta,\phi,\omega)e^{i\omega\tau_1(\theta,\phi,\omega)},\ \ldots,\ \alpha_J(\theta,\phi,\omega)e^{i\omega\tau_J(\theta,\phi,\omega)}]^T, \tag{28}$$

and the complex, frequency-domain weight vector $h_i(\omega)$ contains the Fourier coefficients for L=M/2+1 frequencies, generated by taking the Fourier transform of the overall weight vector w of Equation (23). The frequency-domain band center frequencies are defined by the sampling rate used in the A/D conversion and the length of the discrete FIR filter used in the beamformer. The amplitude coefficients $\alpha_i(\theta,\phi,\omega)$ and time delay functions $\tau_i(\theta,\phi,\omega)$ are the amplitudes and phase delays due to the diffraction process around the device.

As an example, in order to generate the four frequency-domain eigenbeam outputs $Y_0^0(\theta, \phi)$, $Y_1^{-1}(\theta, \phi)$, $Y_1^0(\theta, \phi)$, and $Y_1^1(\theta, \phi)$ for a first-order spherical decomposition of the incoming soundfield, Equation (27) is applied four different times to the microphone output signals $d(\theta, \phi, \omega)$, once for each different eigenbeam output and using a different weight vector $h_i(\omega)$ corresponding to the i-th eigenbeam output.

For a device having a complicated geometry that does not enable a straightforward closed-form solution of the diffraction around the device, the four weight vectors $h_i(\omega)$ are computed from measured data generated by placing the device in an anechoic chamber and sequentially insonifying the device with different, appropriate acoustic signals from many different spherical angles around the device. At each direction $\theta_l$ and $\phi_l$ and frequency $\omega_m$, the microphone output signal vector $d(\theta_l,\phi_l,\omega_m)$ is recorded. All of the measured diffraction filters are then represented as a matrix D whose rows are the transpose of the vectors d for each direction and frequency. The number of different directions chosen for sampling the spatial response measurements is dependent on the accuracy that is desired to compute the complex weights that meet a desired beamformer response design criterion. A minimum number of angles are needed in order to sufficiently sample the beampattern shape so that the optimization results in the desired eigenbeampattern. For order less than third order, spherical angles in increments of 5 degrees or less should be sufficient.

As an example, for each of the four different spherical harmonics of a first-order 3D decomposition, the corresponding weight vector $h(w_l)$ can be numerically obtained by solving the following Equation (29), which expresses the mean square error between the desired beampattern $b_i(\theta_l,\phi_l)$ at the L measurement angles and the measured beampattern $D(\omega)^H h_i(\omega_l)$ as follows:

$$\underset{h_i(\omega_l)}{\arg\min}\,\|D(\omega_l)^H h_i(\omega_l) - b_i\|^2 = \underset{h_i(\omega_l)}{\arg\min}\,\|\tilde{b}_i - b_i\|^2 \tag{29}$$

where the "arg min" function returns a value for the weight vector $h_i(w_l)$ that minimizes the mean square error term.

The above optimization is done for each of the 1+M/2 frequencies in the frequency domain. The solution to the least-squares problem of Equation (29) can be derived using Equation (30) as follows:

$$h_i(\omega)=D(\omega)^H D(\omega))^{-1} D(\omega)^H b_i. \tag{30}$$

The least-squares solution of Equation (30) can lead to beamformer designs that are not robust since the problem can be ill-posed, resulting in the matrix $D^H D$ being singular or nearly singular due to the specific geometry and positioning of the microphones on the device. Robustness is of great importance since it directly relates to realization issues like microphone mismatch and self-noise as well as limitations due to the front-end electronics, and the solution typically becomes more sensitive at lower frequencies where the acoustic wavelength is much larger than the distance between pairs of microphones. To deal with the lack of robustness, it is common to either add an uncorrelated "diagonal noise" term sometimes referred to as regularization to the matrix $D(\omega)^H D(\omega)$ or to add specific constraints to force the solution towards something more robust. One such constraint is the White-Noise-Gain (WNG) constraint, which can be added to the optimization given in Equation (29) according to Equation (31) as follows:

$$\underset{h_i(\omega_l)}{\arg\min}\,\|D(\omega_l)^H h_i(\omega_l) - b_i\|^2 = \underset{h_i(\omega_l)}{\arg\min}\,\|\tilde{b}_i - b_i\|^2 \tag{31}$$

subject to $$WNG_i(\omega) = \frac{|h_i^H(\omega) d_i(\omega)|^2}{h_i^H(\omega) h_i(\omega)} \geq \delta, \text{ for } i = 1, J$$

where $\delta$ is a desired threshold value that is set to control the robustness of the solution. For practical implementations using off-the-shelf microphones, the threshold value is typically set to $\delta \geq 0.25$, which means that the desired beamformer is allowed to lose 12 dB of SNR through the beamforming process in order to match the desired beampattern.

Additional linear and/or quadratic constraints can be added depending on the desired properties of the solution. It is also possible to bias the solution to be more precise at certain angles or angular regions by weighting the solution properly by assigning more weight to the fidelity of the solution at specific angles or angular regions. Assuming that the optimization problem as stated by Equations (29) and (31) is a convex problem, a solution to this quadratically constrained quadratic problem (QCQP) can be obtained by using numerical optimization software such as provided by the Matlab Optimization Toolbox or CVX. See Michael Grant and Stephen Boyd, "CVX: Matlab software for disciplined convex programming," Version 2.0 beta (http://cvxr.com/cvx, September 2013), and Michael Grant and Stephen Boyd, "Graph implementations for nonsmooth convex programs," Recent Advances in Learning and Control (a tribute to M. Vidyasagar), V. Blondel, S. Boyd, and H. Kimura, editors, pages 95-110, Lecture Notes in Control and Information Sciences (http://stanford.edu/~boyd/graph_dcp.html, Springer, 2008), the teachings of both of which are incorporated herein by reference in their entirety. If D is positive semidefinite, then the problem as defined by Equations (29) and (31) is convex, since the function is convex and the quadratic constraint is convex.

Any number of desired beampatterns can be formed so it would be straightforward to form $(N+1)^2$ beampatterns that are the spherical harmonics up to order N as represented by Equation (32) as follows:

$$b_i(\theta_l,\phi_l) \approx Y_n^m(\theta_l,\phi_l) \text{ for } l=1,L \text{ and } i=1,(N+1)^2, \tag{32}$$

where the vector $Y_n^m(\theta_l, \phi_l)$ contains the samples of the spherical harmonics at the L measurement spherical angles used in the measurement of the diffraction and scattering transfer functions on the device on which the microphones are mounted.

Since any beampattern of order N can be formed using at least $(N+1)^2$ microphones that have sufficient geometric sampling of the sound field, a selective subset of basis beampatterns can be formed. These basis beampatterns are desired to be spatially orthonormal (or at least orthogonal), but they could be non-orthogonal or approximately orthogonal. For instance, if it is desired to steer in only two dimensions, only three basis beampatterns would be required and not four as for a general first-order 3D decomposition. Similarly, it is possible to choose other subsets of the basis decomposition that have other implementation restrictions such as limited steering angles.

Although the above discussion has been focused on a spherical harmonic decomposition, it is also possible to use the method for other desired orthogonal expansions such as oblate and prolate spheroidal expansions, circular and elliptic cylinders, and conical and wedge expansions as well as non-orthogonal expansions.

When a device of the present invention is a handheld device such as a cell phone or a camera, the frame of reference of the audio data generated by the device relative to the ambient acoustic environment will move (i.e., translate and/or rotate) as the device moves. In certain situations, such as recording a live concert, it might be desired to keep the acoustic scene stable and independent of the device motion. In certain embodiments, devices of the present invention include motion sensors that can be used to characterize the motion of the device. Such motion sensors may include, for example, multi-axis accelerometers, magnetometers, and/or gyroscopes as well as one or more cameras, where the image data generated by the cameras can be processed to characterize the motion of the device. Such motion-sensor signals can be utilized to generate a steady, fixed audio scene even though the device was moving when the original audio data was generated. To allow for a fixed auditory scene perspective in this case, the spatial eigenbeam signal could be dynamically adjusted based on the motion-sensor signals to rotate the basis eigenbeam signals to compensate for the device motion. For instance, if the device has an initial or desired orientation, and the user rotates the device to some other direction such that the microphone axes have a different orientation, the motion-sensor signals can be used to electronically rotate the audio data to the original orientation directions to keep the audio frame of reference constant. In this way, electronic motion compensation of the underlying basis signals will keep the auditory perspective on playback fixed and stable with respect to the original recording position of the device. If the motion-sensor signals are also stored for later playback (either on or off the device), then the sound perspective relative to the device can also be stored using the unmodified basis signals, where the end user could still select a fixed auditory perspective by using the stored motion-sensor signals to adjust the unmodified basis signals.

In a single device, such as a camera, that has both an audio system for generating audio data as described herein and a video system for generating image data, motion of the camera is inherently synchronized to the geometry of the microphone array since both systems are part of the same device. In other situations, the device that generates the audio data may be different from and may move relative to the device that generates the image data. Here, too, motion-sensor signals from either or both devices can be used to correlate and adjust the audio frame of reference with respect to the video frame of reference. For example, signals from motion sensors in the camera can be used to post-process the audio data from a fixed microphone array to follow the translation and rotation of the camera. For instance, if the camera has been oriented in some new direction, then the motion-sensor signals can be used to rotate the audio device eigenbeamformers to align with the new camera orientation by electronically manipulating the audio signals from the fixed microphone array. Similarly, if the camera is fixed and the audio device containing the microphone array is moving, then motion sensors in the moving audio device can be used to modify the basis signals so that they maintain a fixed audio frame of reference that is consistent with the fixed orientation of the camera. In general, movement of one or both devices can be compensated to maintain a desired fixed perspective on the image and acoustic scenes that are being transmitted and/or recorded. It should be noted that one could also record the motion-sensor signals themselves and use these signals in post processing to affect the audio and image stabilization from the original recordings. One could also have the visual frame and acoustic frame rotated relative to each other at some desired offset.

Alternatively or in addition, two or more different audio devices of the present invention may be used to generate different sets of audio data in parallel. Here, too, motion-sensor signals from one or more of the audio devices can be used to compensate for relative motion between different audio devices and/or relative motion between the audio devices and the ambient acoustic environment. Whether or not the different sets of audio data are adjusted for motion, in some embodiments, the different sets of audio data generated by the different audio devices can be combined to provide a single set of audio data. For example, the omni signals of multiple first-order B format outputs from the multiple devices can be combined (e.g., averaged) to form a single, higher-fidelity omni signal. Similarly, the different x-component dipole signals of those first-order B format outputs can be combined to form a single, higher-fidelity x-component dipole signal and similarly for the y and z components.

Figure 10:
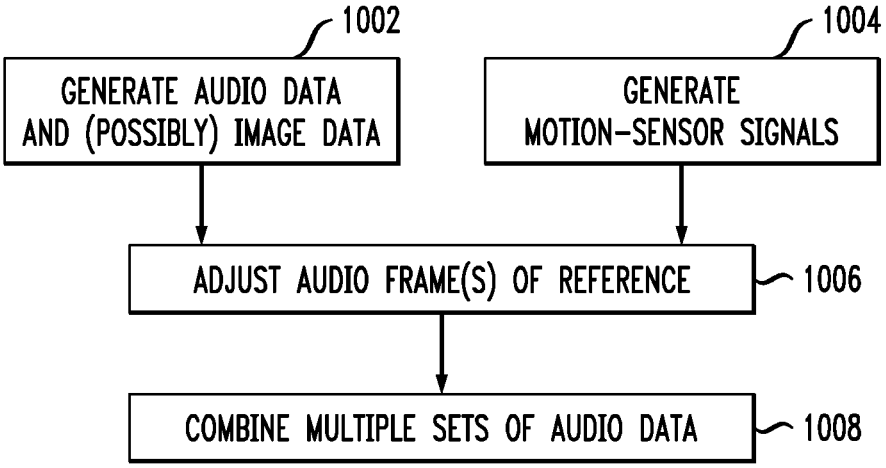
FIG. 10 is a flow diagram of data processing according to certain embodiments of the invention.

FIG. 10 is a high-level flow diagram of the data processing performed to compensate for motion of one or more devices used to generate the processed data. Depending on the particular implementation, the data processing of FIG. 10 could be implemented by one of the data-generating devices or on yet another device, and the data processing could be implemented in real-time or during a post-processing phase after transmission and/or storage of the original data.

In step 1002, one or more sets of audio data are generated using one or more audio devices of the present invention, such as device 700 or 750 of FIGS. 7A-7D, having signal processing systems, such as shown in FIGS. 6, 8, and 9. In addition, image data may also be generated by one of the same devices or by a separate device. Concurrently, in step 1004, motion-sensor signals are generated by motion sensors attached to one or more of the same devices that generate data in step 1002. In step 1006, one or more sets of audio data generated in step 1002 are processed based on the motion-sensor signals generated in step 1004 to adjust their audio frames of reference to compensate for motion of one or more of the devices. In step 1008, multiple sets of audio data are combined to generate a set of combined audio data.

Equation (31) is an expression to compute the White-Noise-Gain (WNG) for any of the designed basis beampatterns. Since a general, desired spatial response beampattern for spatial rendering of the sound field typically involves all basis beampattern signals, it is undesirable to have widely varying noise between the basis beampatterns. Thus, the computed WNG can be used for each basis beampattern to identify issues related to widely varying WNG for each of the basis beampatterns. A widely varying WNG would indicate a spatially deficient microphone placement or geometry. It could be possible to use the varying WNG between basis beampatterns as a guide to what dimensions in the design are deficient in spatial sampling. Therefore, differences in the WNG could offer guidance on how the microphone positions might be adjusted to improve the design.

Due to the practical limitations on the number of microphones and the number of microphone positions, it might not be possible to realize all the basis beampatterns with similar WNG values. In this case, a noise suppression algorithm could be employed that would increase the amount of noise suppression on basis patterns that had lower WNG (i.e., noisier basis beampatterns). The amount of noise suppression could be directly related to the differences in WNG or some function of WNG. Noise suppression algorithms can also be tailored to exploit the known self-noise from the selected microphones and the associated electronics used in the device design.

Another possible method to deal with widely varying WNG between the basis beampatterns would be to form these basis beampatterns in other "directions" by choosing different directions for the underlying axes so that the WNGs between the various basis beampatterns are more closely matched. Finally, since the WNG variable is a strong function of frequency, the basis beampatterns could be identified with some metadata information that indicates at what frequencies the basis beampattern's WNG falls below some set threshold. If the WNG falls below that threshold at some cutoff frequency, then these basis signals would no longer be utilized below the cutoff frequency when forming a desired spatial beampattern or spatial playback signal. Thus, the maximum order of basis beampatterns as a function of frequency can be set by identifying at what frequencies the WNG falls below some desired minimum.

Another metric that can be used to identify possible design implementation issues is the least-square error (i.e., the term contained by the magnitude squared expression in Equation (29)) of the desired basis beampatterns as a function of frequency. Since spatial aliasing can become an issue at higher frequencies (where the average spacing between microphones exceeds a fraction of the acoustic wavelength), a change in the least-square error as frequency increases could be used to detect and therefore address the aliasing problem. If this problem is observed, then the designer can be alerted that the microphone spacings should be investigated due to a rapidly increasing error at higher frequencies. It should be possible to determine what microphones are improperly spaced by examining the error as a function of the basis beampatterns and the weights used to build the beampatterns.

As the frequency increases, at some higher frequency, acoustic spatial aliasing from beamforming with the spaced microphone array will become a design problem for the optimized basis beamformers, and either no solution for the desired basis beamformer can be found or the solution is non-robust to implementation or both. One possible way to deal with the eventual undesired effects of spatial aliasing at higher frequencies is to use the natural scattering and diffraction of the device's physical body to attain a higher directivity that could result in a relatively narrow beam in fixed directions. A subset of clustered microphones that utilize a different optimized beampattern designed to maximize directional gain from the subset could be realized to form beams in specific directions around the device. These angularly distinct beams could then be used to approximate the desired spatial signal coming from the beam directions. Using these multiple, high-frequency beams (which might not be related to the lower-frequency basis beampatterns) could allow one to virtualize these optimized diffractive beams into signals that could be used to extend the lower-frequency basis domain to increase the bandwidth of any spatial audio system that utilizes the basis signals' design approach.

Yet another potential issue that can dynamically impact proper operation of the optimized basis beamformer design is that the user's hand can drastically change the scattering and diffraction around the phone and even possibly occlude one or more microphones during operation. There is also the potential for one or more microphones to fail in a way that makes them unusable in processing. In order to address these possibilities, different sets of optimizations could be stored in the device that would be used when detrimental hand presence near the microphones or microphone failure is detected. Capacitive, ultrasonic transducers and cameras in the phone could be used to detect improper nearfield hand acoustic impact. For example, in the arrangement of FIGS. 7A-7B, signals from such components could be used to determine whether to use the signals from microphones 701-704 or the signals from microphones 705-708 in generating the output beampatterns. Detrimental nearfield objects will cause larger energy in the higher-order basis beampatterns relative to the lower-order basis beampatterns compared to energy ratios for farfield sources.

Therefore, an increased ratio of basis signal powers between different orders of the basis beampatterns can also be used to detect wind and structural handling noise. Comparison of the output energies could be utilized to detect these potential issues and either reduce the maximum order of the basis beampatterns or choose another set of weight optimizations based on measurements made that include the impact of the detrimental effects of hand presence near the microphones. Optimizations can also be obtained to deal with asymmetric wind ingestion or localized structural handling noise at some subset of microphones. Similarly, when an occluded or failed microphone is detected, another set of optimized basis beamformers can be utilized based on optimizations made during the design phase based on leaving out microphones in the optimization. Depending on the actual microphones that failed or were occluded, it could be optimum to reduce the highest-order basis beampatterns.

Other optimization techniques could be utilized to compute the optimum weights for the basis beampatterns such as iterative methods (e.g., Newton's method), genetic algorithms, simulated annealing, total least squares (TLS), and relaxation methods. See David G. Luenberger, Y. Ye, *Linear and nonlinear programming: International Series in Operations Research & Management Science* 116 (Third ed.), New York: Springer, 2008, the teachings of which are incorporated herein by reference in their entirety.

The use of multiple microphones on a mobile device like a cell phone, camera, or tablet can enable, through signal processing of the microphone signals, the decomposition of the incident spatial sound field into canonical spatial outputs (eigenbeams or equivalently Higher-Order Ambisonics (HOA)) that can be used later to render spatial audio playback. The eigenbeams can be processed by relatively straightforward transformations to allow the spatial playback to be rendered such that a listener or listeners can angularly move their heads and the rendering can be modified dependent on their individual head motion. The ability to render dynamic real-time spatially accurate binaural or stereo audio or playback on loudspeaker systems that can render spatialized audio can be used to enhance a listener's virtual auditory experience of a real event. Combining spatially realistic audio with spatially rendered and linked video (either stereoscopically or a screen display) that can be dynamically rotated, can significantly increase the impression of virtually being at the location where the recording was made.

Mobile devices such as tablets and cell phones are usually thin parallelepipeds with the screen area defining the two larger dimensions. For accurate spatial decomposition of the sound field, signals related to the first and higher-order pressure differences are employed. As shown above, the output SNR of a differential beamformer is directly related to the distance between the microphones. Since the device is much thinner in depth than the screen size, it is therefore commensurately difficult to obtain a signal with an SNR in a direction normal to the plane of the screen that is similar to the signals corresponding to the larger spacings that are supported by the two larger dimensions. One apparent problem is the very small geometric spacing (typically around 6 mm) between the microphones on opposite sides on the device in the front and back planes defined by the screen and the back of the device relative to the other pairs (having typical spacing of approximately 20 mm) that are mounted along the larger dimensions of the device. However, it is shown here that it is possible to exploit the effects of acoustic scattering and diffraction around the device to obtain a much higher SNR output than what could be obtained by the microphones without taking into account the body of the device. In fact, it is possible to obtain a higher SNR for pressure differentials along this normal axis than those along the other orthogonal axes with minimal diffraction effects that have larger geometric spacing between the microphones used to form the other orthogonal pressure differentials.

It was shown above how to form the first-order B-format decomposition by utilizing at least four microphones mounted on a mobile device surface by appropriately combining these microphones in a differential manner. One arrangement using five microphones was shown where one of the microphones was shared in the array to form three orthogonal first-order differential dipole signals. A numerical design method was described where the eigenbeam signals (e.g., HOA components) are computed from a number of microphones distributed on the surface of the device. The method involves the measurement of transfer functions taken at multiple spherical angles around a scattering and diffractive device and computing a constrained optimization solution for the corresponding weights that result in the desired spatial response such as the spherical harmonic eigenbeams (e.g., HOA). It was discussed that adding a White-Noise-Gain quadratic constraint to the optimal weights optimization problem can be used to control the solution robustness in a matrix inverse solution. There are also other methods that can be utilized to compute the "optimal" desired beampattern weights that include weighted least squares, total least squares, and optimization regarding various optimization norms such as the $l_1$-norm and the $l_\infty$-norm.

Although the above development discussed forming a time-domain set of basis beampattern signals, the implementation can be equivalently realized in the frequency domain or subband domain. Also, the time- or frequency-domain signals can be recorded and used for later formation and editing to allow for non-realtime operation.

Although the invention has been described in the context of microphone arrays having arrangements for omnidirectional microphones, in other embodiments, the arrays can have one or more higher-order microphones instead of or in addition to omni pressure microphones.

Although the invention has been described in the context of mobile devices, such as cell phones and tablets, having general parallelepiped shapes, the invention can be applied to any devices having a non-spheroidal shape. For example, a camera (or camcorder) that records both acoustic and (motion or still) images can be configured with an array of microphones and an audio processing system in accordance with the present invention. The invention can also be applied to devices having a spheroidal shape, including spheres, oblates, and prolates.

The present invention can be implemented for a wide variety of applications requiring spatial audio signals, including, but not limited to, consumer devices such as laptop computers, hearing aids, cell phones, tablets, and consumer recording devices such as audio recorders, cameras, and camcorders.

Although the present invention has been described in the context of air applications, the present invention can also be applied in other applications, such as underwater applications. The invention can also be useful for determining the location of an acoustic source, which involves a decomposition of the sound field into an orthogonal or desired set of spatial modes or spatial audio playback of the spatial sound field as a preprocessor step in more-standard source localization systems.

In certain embodiments, an article of manufacture comprises a device body having a non-spheroidal shape, a plurality of microphones configured at a plurality of different locations on the device body, each microphone configured to generate a corresponding microphone signal from an incoming acoustic signal, and a signal-processing system configured to process the microphone signals to generate a first set of four different output audio signals corresponding a zeroth-order beampattern and three first-order beampatterns in three non-planar directions. The signal-processing system is configured to generate the output audio signal corresponding to at least one of the first-order beampatterns based on effects of the device body on the incoming acoustic signal. For each of the non-parallel directions, the microphone signals used to generate the corresponding output audio signal have an inter-microphone effective distance that is less than a wavelength at a specified high-frequency value.

In at least some of the above embodiments, the specified high-frequency value is 8 kHz, and each inter-microphone effective distance is less than 4 cm.

In at least some of the above embodiments, for each of the non-parallel directions, the inter-microphone effective distance is less than half the wavelength at the specified high-frequency value.

In at least some of the above embodiments, the specified high-frequency value is 8 kHz, and each inter-microphone effective distance is less than 2 cm.

In at least some of the above embodiments, for each of the non-parallel directions, the microphone signals used to generate the corresponding output audio signal have a phase center, and, for each pair of the three non-parallel directions, an inter-phase-center effective distance between the two corresponding phase centers is less than the wavelength at the specified high-frequency value.

In at least some of the above embodiments, the specified high-frequency value is 8 kHz, and each inter-microphone effective distance and each inter-phase-center effective distance is less than 4 cm.

In at least some of the above embodiments, each inter-microphone effective distance and each inter-phase-center effective distance is less than half the wavelength at the specified high-frequency value.

In at least some of the above embodiments, the specified high-frequency value is 8 kHz, and each inter-microphone effective distance and each inter-phase-center effective distance is less than 2 cm.

In at least some of the above embodiments, the three non-planar directions are three mutually orthogonal directions.

In at least some of the above embodiments, the device body has a substantially parallelepiped shape.

In at least some of the above embodiments, the plurality of microphones comprise first and second subsets of microphones, for each of the first and second subsets of microphones, for each of the non-parallel directions, the inter-microphone effective distance is less than the wavelength at the specified high-frequency value, and the signal-processing system is configured to generate (i) a first set of the four output audio signals based on microphone signals from the first subset of microphones and (ii) a second set of the four output audio signals based on microphone signals from the second subset of microphones, wherein the first and second sets of the four output audio signals corresponding to a binaural or stereo representation of the incoming acoustic signal.

In at least some of the above embodiments, the plurality of microphones comprise first, second, third, and fourth microphones (e.g., 705-708), the first and second microphones (e.g., 705 and 706) are aligned along a first of the three non-planar directions (e.g., x) and microphone signals from the first and second microphones are used to generate the output audio signal corresponding to the first-order beampattern in the first direction, the third and fourth microphones (e.g., 707 and 708) are aligned along a second of the three non-planar directions (e.g., z) and microphone signals from the third and fourth microphones are used to generate the output audio signal corresponding to the first-order beampattern in the second direction, and microphone signals from the first and second microphones are used to generate an effective microphone signal that is used, along with microphone signals from at least one of the third and fourth microphones, to generate the output audio signal corresponding to the first-order beampattern in the third direction (e.g., y).

In at least some of the above embodiments, the plurality of microphones further comprise fifth, sixth, seventh, and eighth microphones (e.g., 701-704); the fifth and sixth microphones (e.g., 701 and 702) are aligned along the first direction; and the seventh and eighth microphones (e.g., 703 and 704) are aligned along the second direction.

In at least some of the above embodiments, microphone signals from the fifth, sixth, seventh, and eighth microphones are used to generate a second set of four different output audio signals corresponding a zeroth-order beampattern and three first-order beampatterns in the three non-planar directions.

In at least some of the above embodiments, microphone signals from the fifth, sixth, seventh, and eighth microphones are used, along with the microphone signals from the first, second, third, and fourth microphones, to generate the first set of four different output audio signals.

In at least some of the above embodiments, the plurality of microphones comprise first, second, third, fourth, and fifth microphones (e.g., 751-755); the first and second microphones (e.g., 751 and 752) are aligned along a first of the three non-planar directions (e.g., y) and microphone signals from the first and second microphones are used to generate the output audio signal corresponding to the first-order beampattern in the first direction; the second and third microphones (e.g., 752 and 753) are aligned along a second of the three non-planar directions (e.g., x) and microphone signals from the second and third microphones are used to generate the output audio signal corresponding to the first-order beampattern in the second direction; and the fourth and fifth microphones (e.g., 754 and 755) are aligned along a third of the three non-planar directions (e.g., z) and microphone signals from the fourth and fifth microphones are used to generate the output audio signal corresponding to the first-order beampattern in the third direction.

In at least some of the above embodiments, the signal-processing system is configured to use different subsets of the microphones to generate the output audio signals for different frequency ranges.

In at least some of the above embodiments, for acoustic signals having frequency below a specified cutoff frequency, the signal-processing system is configured to use microphones having relatively large inter-microphone effective distances to generate the output audio signals; and, for acoustic signals having frequency above the specified cutoff frequency, the signal-processing system is configured to use microphones having relatively small inter-microphone effective distances to generate the output audio signals.

In at least some of the above embodiments, for acoustic signals having frequency below a specified cutoff frequency, the signal-processing system is configured to use a larger number of the microphones to generate the output audio signals; and, for acoustic signals having frequency above the specified cutoff frequency, the signal-processing system is configured to use a smaller number of the microphones to generate the output audio signals.

The present invention may be implemented as analog or digital circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value of the value or range.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It will be further understood that various changes in the details, materials, and arrangements of the parts which have been described and illustrated in order to explain the nature of this invention may be made by those skilled in the art without departing from the principle and scope of the invention as expressed in the following claims. Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

Embodiments of the invention may be implemented as (analog, digital, or a hybrid of both analog and digital) circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing blocks in a software program. Such software may be employed in, for example, a digital signal processor, micro-controller, general-purpose computer, or other processor.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Signals and corresponding terminals, nodes, ports, or paths may be referred to by the same name and are interchangeable for purposes here.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

Embodiments of the invention can be manifest in the form of methods and apparatuses for practicing those methods. Embodiments of the invention can also be manifest in the form of program code embodied in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the invention. Embodiments of the invention can also be manifest in the form of program code, for example, stored in a non-transitory machine-readable storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits Any suitable processor-usable/readable or computer-usable/readable storage medium may be utilized. The storage medium may be (without limitation) an electronic, magnetic, optical, electromagnetic, infrared, or semiconductor system, apparatus, or device. A more-specific, non-exhaustive list of possible storage media include a magnetic tape, a portable computer diskette, a hard disk, a random access memory (RAM), a read-only memory (ROM), an erasable programmable read-only memory (EPROM) or Flash memory, a portable compact disc read-only memory (CD-ROM), an optical storage device, and a magnetic storage device. Note that the storage medium could even be paper or another suitable medium upon which the program is printed, since the program can be electronically captured via, for instance, optical scanning of the printing, then compiled, interpreted, or otherwise processed in a suitable manner including but not limited to optical character recognition, if necessary, and then stored in a processor or computer memory. In the context of this disclosure, a suitable storage medium may be any medium that can contain or store a program for use by or in connection with an instruction execution system, apparatus, or device.

The functions of the various elements shown in the figures, including any functional blocks labeled as "processors," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those of ordinary skill in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Embodiments of the invention can also be manifest in the form of a bitstream or other sequence of signal values stored in a non-transitory recording medium generated using a method and/or an apparatus of the invention.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An article of manufacture comprising:

a device body having a non-spheroidal shape;

a plurality of microphones configured at a plurality of different locations on the device body, each microphone configured to generate a corresponding microphone signal from an incoming acoustic signal;

a signal-processing system configured to process the microphone signals to generate a first set of four different output audio signals corresponding to a zeroth-order beampattern and three first-order beampatterns in three non-planar directions; and at least one motion sensor configured to generate motion-based signals that can be used to compensate one or more of the output audio signals for relative motion of the device body, wherein:

the signal-processing system is configured to generate the output audio signal corresponding to at least one of the first-order beampatterns based on effects of the device body on the incoming acoustic signal; and the signal-processing system is configured to use the motion-based signals to compensate the one or more output audio signals for the relative motion of the device body by rotating the output audio signals corresponding to the three first-order beampatterns to maintain a fixed audio frame of reference.

2. The article of claim 1, wherein the three non-planar directions are three mutually orthogonal directions.

3. The article of claim 1, wherein the device body has a substantially parallelepiped shape.

4. The article of claim 1, wherein the signal-processing system is configured to use different subsets of the microphones to generate the output audio signals for different frequency ranges.

5. The article of claim 1, wherein:

the at least one motion sensor comprises a video camera configured to generate a video signal corresponding to the microphone signals; and the motion-based signals are derivable from the video signal.

6. The article of claim 1, wherein, for each of the non-parallel directions, the microphone signals used to generate the corresponding output audio signal have an inter-microphone effective distance that is less than a wavelength at a specified high-frequency value.

7. The article of claim 6, wherein:

the specified high-frequency value is 8 kHz; and each inter-microphone effective distance is less than 4 cm.

8. The article of claim 6, wherein, for each of the non-parallel directions, the inter-microphone effective distance is less than half the wavelength at the specified high-frequency value.

9. The article of claim 8, wherein:

the specified high-frequency value is 8 kHz; and each inter-microphone effective distance is less than 2 cm.

10. A method comprising:

generating, for each of a plurality of microphones configured at a plurality of different locations on a device body having a non-spheroidal shape, a corresponding microphone signal from an incoming acoustic signal;

processing the microphone signals to generate a first set of four different output audio signals corresponding to a zeroth-order beampattern and three first-order beampatterns in three non-planar directions; and generating motion-based signals that can be used to compensate one or more of the output audio signals for relative motion of the device body, wherein:

the output audio signal corresponding to at least one of the first-order beampatterns is generated based on effects of the device body on the incoming acoustic signal; and the motion-based signals are used to compensate the one or more output audio signals for the relative motion of the device body by rotating the output audio signals corresponding to the three first-order beampatterns to maintain a fixed audio frame of reference.

11. The method of claim 10, wherein:

a video signal is generated corresponding to the microphone signals; and the motion-based signals are derived from the video signal.

12. The method of claim 10, further comprising:

generating a video signal using a video camera that moves relative to the microphones of the device body;

using the motion-based signals to maintain correlated frames of reference for the output audio signals and the video signal.

13. The method of claim 12, wherein the motion-based signals are used to maintain a common frame of reference for the output audio signals and the video signal.

14. The method of claim 10, further comprising:

generating at least one other microphone signal using at least one other microphone that moves relative to the microphones of the device body;

using the motion-based signals to determine correlated frames of reference for the microphone signals from the microphones of the device body and the at least one other microphone signal.

15. The method of claim 14, wherein the motion-based signals are used to determine a common frame of reference for the microphone signals from the microphones of the device body and the at least one other microphone signal.

16. The method of claim 15, wherein the microphone signals from the microphones of the device body and the at least one other microphone signal having the common frame of reference are combined to generate the output audio signals.

17. The method of claim 10, wherein, for each of the non-parallel directions, the microphone signals used to generate the corresponding output audio signal have an inter-microphone effective distance that is less than a wavelength at a specified high-frequency value.

18. The method of claim 17, wherein:

the specified high-frequency value is 8 kHz; and each inter-microphone effective distance is less than 4 cm.

19. The method of claim 17, wherein, for each of the non-parallel directions, the inter-microphone effective distance is less than half the wavelength at the specified high-frequency value.

20. The method of claim 19, wherein:

the specified high-frequency value is 8 kHz; and each inter-microphone effective distance is less than 2 cm.

* * * * *